US008857956B2

(12) United States Patent
Tomoguchi et al.

(10) Patent No.: US 8,857,956 B2
(45) Date of Patent: Oct. 14, 2014

(54) CARTRIDGES AND RECORDING APPARATUSES

(71) Applicants: Suguru Tomoguchi, Nagoya (JP); Noritsugu Ito, Tokoname (JP); Akinori Igarashi, Kasugai (JP); Tadanobu Chikamoto, Nagoya (JP); Hideki Shioya, Nagoya (JP)

(72) Inventors: Suguru Tomoguchi, Nagoya (JP); Noritsugu Ito, Tokoname (JP); Akinori Igarashi, Kasugai (JP); Tadanobu Chikamoto, Nagoya (JP); Hideki Shioya, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/706,109

(22) Filed: Dec. 5, 2012

(65) Prior Publication Data

US 2013/0141499 A1 Jun. 6, 2013

(30) Foreign Application Priority Data

Dec. 6, 2011 (JP) ..... 2011-267081
Dec. 6, 2011 (JP) ..... 2011-267082

(51) Int. Cl.
*B41J 2/175* (2006.01)
*B41J 25/00* (2006.01)

(52) U.S. Cl.
CPC ..... *B41J 25/00* (2013.01); *B41J 2/1753* (2013.01)
USPC ..... 347/86

(58) Field of Classification Search
CPC ..... B41J 2/1752
USPC ..... 347/86
See application file for complete search history.

(56) References Cited

U.S. PATENT DOCUMENTS

| | | | | |
|---|---|---|---|---|
| 5,245,361 | A * | 9/1993 | Kashimura et al. | 347/50 |
| 5,506,611 | A * | 4/1996 | Ujita et al. | 347/86 |
| 6,003,985 | A | 12/1999 | Bekki | |
| 6,070,975 | A * | 6/2000 | Uchikata et al. | 347/86 |
| 6,488,369 | B1 * | 12/2002 | Steinmetz et al. | 347/86 |
| 7,004,564 | B2 * | 2/2006 | Steinmetz et al. | 347/49 |
| 7,293,864 | B2 | 11/2007 | Kimura et al. | |
| 7,484,825 | B2 | 2/2009 | Asauchi | |

(Continued)

FOREIGN PATENT DOCUMENTS

| | | |
|---|---|---|
| EP | 0710568 A2 | 5/1996 |
| EP | 1344650 A1 | 9/2003 |

(Continued)

OTHER PUBLICATIONS

European Patent Office, Extended European Search Report for European Patent Application No. 12195809.4 (EP counterpart to above-captioned patent application), mailed Apr. 10, 2014.

*Primary Examiner* — Stephen Meier
*Assistant Examiner* — Alexander D Shenderov
(74) *Attorney, Agent, or Firm* — Baker Botts L.L.P.

(57) ABSTRACT

A cartridge includes a substrate and an engagement portion. The first surface faces a first direction and has a first surface on which an electrical terminal is disposed. The engagement portion includes a second surface disposed upstream from the substrate in the first direction and a third surface. The second surface faces a second direction, which forms an obtuse angle with the first direction. The third surface faces a third direction, which forms an acute angle with the first direction. The third surface does not overlap with the substrate in the first direction and the third surface is disposed downstream from the second surface in the first direction.

14 Claims, 11 Drawing Sheets

(56) References Cited

U.S. PATENT DOCUMENTS

| | | | | |
|---|---|---|---|---|
| 2002/0085075 | A1 | 7/2002 | Shinada et al. | |
| 2004/0135857 | A1 | 7/2004 | Hashii et al. | |
| 2005/0093943 | A1 | 5/2005 | O'Hara et al. | |
| 2009/0251512 | A1 * | 10/2009 | Nozawa et al. | 347/86 |
| 2010/0007700 | A1 | 1/2010 | Muhl | |
| 2010/0225704 | A1 | 9/2010 | Aoki et al. | |
| 2011/0205284 | A1 | 8/2011 | Yoshino et al. | |

FOREIGN PATENT DOCUMENTS

| | | | |
|---|---|---|---|
| EP | 2145769 | A2 | 1/2010 |
| GB | 2321623 | A | 8/1998 |
| JP | H09-290515 | A | 11/1997 |
| JP | 2003-011388 | A | 1/2003 |
| JP | 2010-221631 | A | 10/2010 |

* cited by examiner

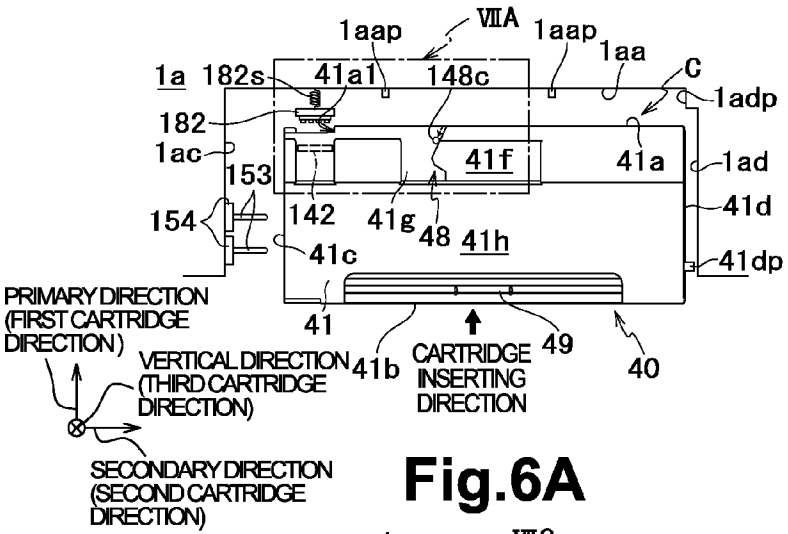
Fig.6A
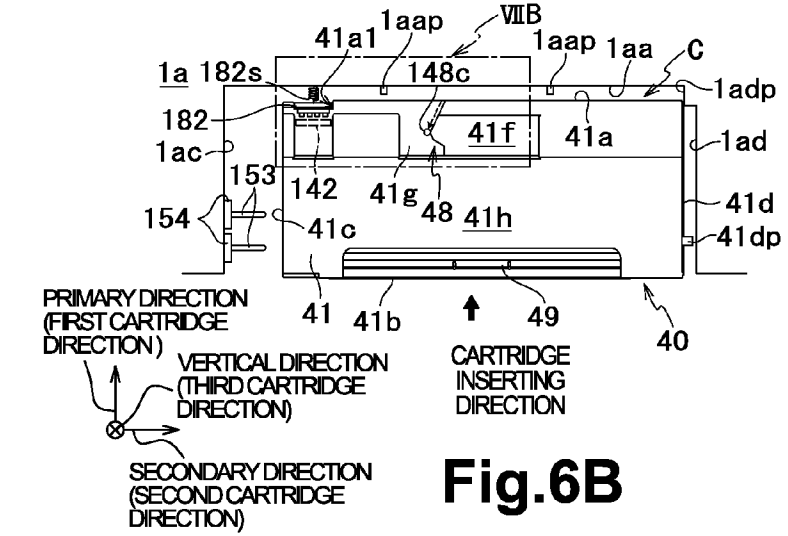
Fig.6B
Fig.6C
Fig.6D

CARTRIDGES AND RECORDING APPARATUSES

CROSS-REFERENCE TO RELATED APPLICATIONS

This application claims priority from Japanese Patent Application No. 2011-267081, filed on Dec. 6, 2011, and Japanese Patent Application No. 2011-267082, filed on Dec. 6, 2011. The disclosures of these applications are incorporated herein by reference.

BACKGROUND OF THE INVENTION

1. Field of the Invention

The invention relates generally to cartridges and recording apparatuses.

2. Description of Related Art

A known cartridge includes electrical contacts and a known recording apparatus includes electrical interfaces in its cartridge receiving portion. The electrical interfaces of the known recording apparatus is configured to contact the electrical contacts of the known cartridge. The electrical contacts are arranged in a direction intersecting a cartridge inserting direction. When the known cartridge is installed in the cartridge receiving portion of the known recording apparatus, the electrical contacts contact the electrical interfaces.

SUMMARY OF THE INVENTION

However, a contact failure may occur between the electrical contacts and the electrical interfaces due to dimensional deviation in one or both of the known cartridge and the cartridge receiving portion of the known recording apparatus with respect to the cartridge inserting direction.

The present invention may provide a cartridge configured to reduce or eliminate a contact failure between an electrical contact and an electrical interface.

According to an embodiment of the invention, a cartridge comprising: a substrate comprising a first surface on which an electrical terminal is disposed, the first surface facing a first direction; and an engagement portion comprising: a second surface disposed upstream from the substrate in the first direction, wherein the second surface faces a second direction, which forms an obtuse angle with the first direction; and a third surface facing a third direction, which forms an acute angle with the first direction, wherein the third surface does not overlap with the substrate in the first direction, wherein the third surface is disposed downstream from the second surface in the first direction.

According to another embodiment of the invention, a cartridge comprising: a substrate comprising a first surface on which an electrical terminal is disposed, the first surface facing a first direction; a second surface disposed upstream from the substrate in the first direction, wherein the second surface faces a second direction, which forms an obtuse angle with the first direction; and a third surface facing a third direction, which forms an acute angle with the first direction, wherein the third surface does not overlap with the substrate in the first direction, wherein the third surface is disposed downstream from the second surface in the first direction, and wherein a portion of the third surface does not overlap any portion of the cartridge in the first direction downstream from the third surface.

According to still another embodiment of the invention, A recording apparatus comprising: a cartridge comprising: a substrate comprising a first surface on which an electrical terminal is disposed, the first surface facing a first direction; and an engagement portion comprising: a second surface facing a second direction, which forms an acute angle with a direction opposite of the first direction; and a third surface disposed downstream from the second surface in the first direction, the third surface facing a third direction, which forms an acute angle with the first direction, wherein a downstream end of the electrical terminal in the first direction is disposed downstream from a downstream end of the second surface in the first direction, a receiving portion configured to receive the cartridge; an electrical interface disposed at the receiving portion and configured to contact the electrical terminal when the receiving portion receives the cartridge; and a locking unit disposed at the receiving portion and configured to urge the cartridge in the first direction by engaging a contact portion of the locking unit with the second surface when the receiving portion receives the cartridge, wherein an upstream end of the electrical interface in the first direction is disposed downstream from the contact portion of the locking unit in the first direction, wherein a distance between the upstream end of the electrical interface and the contact portion of the locking unit in the first direction is greater than a distance between a downstream end of the electrical terminal and a downstream end of the second surface in the first direction.

Accordingly, the cartridge may move along the cartridge inserting direction to allow the electrical contact to contact the electrical interface by contacting the movable member with the first portion of the cartridge. Thus, a contact failure between the electrical contact and the electrical interface may be reduced.

Other objects, features, and advantages will be apparent to persons of ordinary skill in the art from the following detailed description of the invention and the accompanying drawings.

DESCRIPTION OF THE DRAWINGS

For a more complete understanding of the present invention, needs satisfied thereby, and the objects, features, and advantages thereof, reference now is made to the following descriptions taken in connection with the accompanying drawing.

FIG. 6A is a schematic plan view depicting a process of installing a cartridge to a printer according to an embodiment of the invention.

FIG. 6B is another schematic plan view depicting a process of installing a cartridge to a printer according to an embodiment of the invention.

FIG. 6C is still another schematic plan view depicting a process of installing a cartridge to a printer according to an embodiment of the invention.

FIG. 6D is yet another schematic plan view depicting a process of installing a cartridge to a printer according to an embodiment of the invention.

DETAILED DESCRIPTION OF EMBODIMENT OF THE INVENTION

Figure 1:
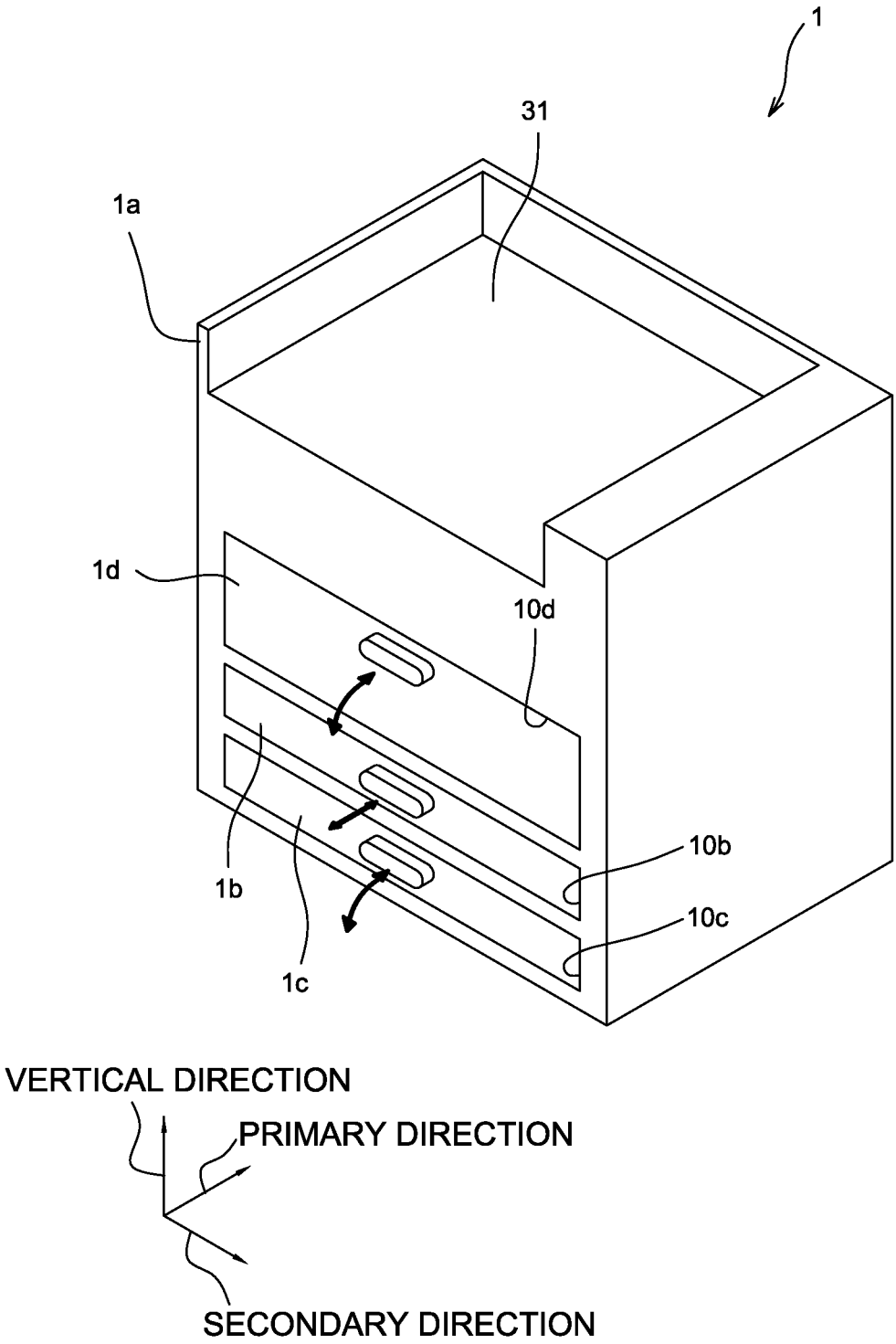
FIG. 1 is a perspective view depicting an inkjet printer according to an embodiment of the invention.

Embodiments of the invention now are described in detail with reference to the accompanying drawings; like reference numerals are used for corresponding parts in the various drawings.

Figure 2:
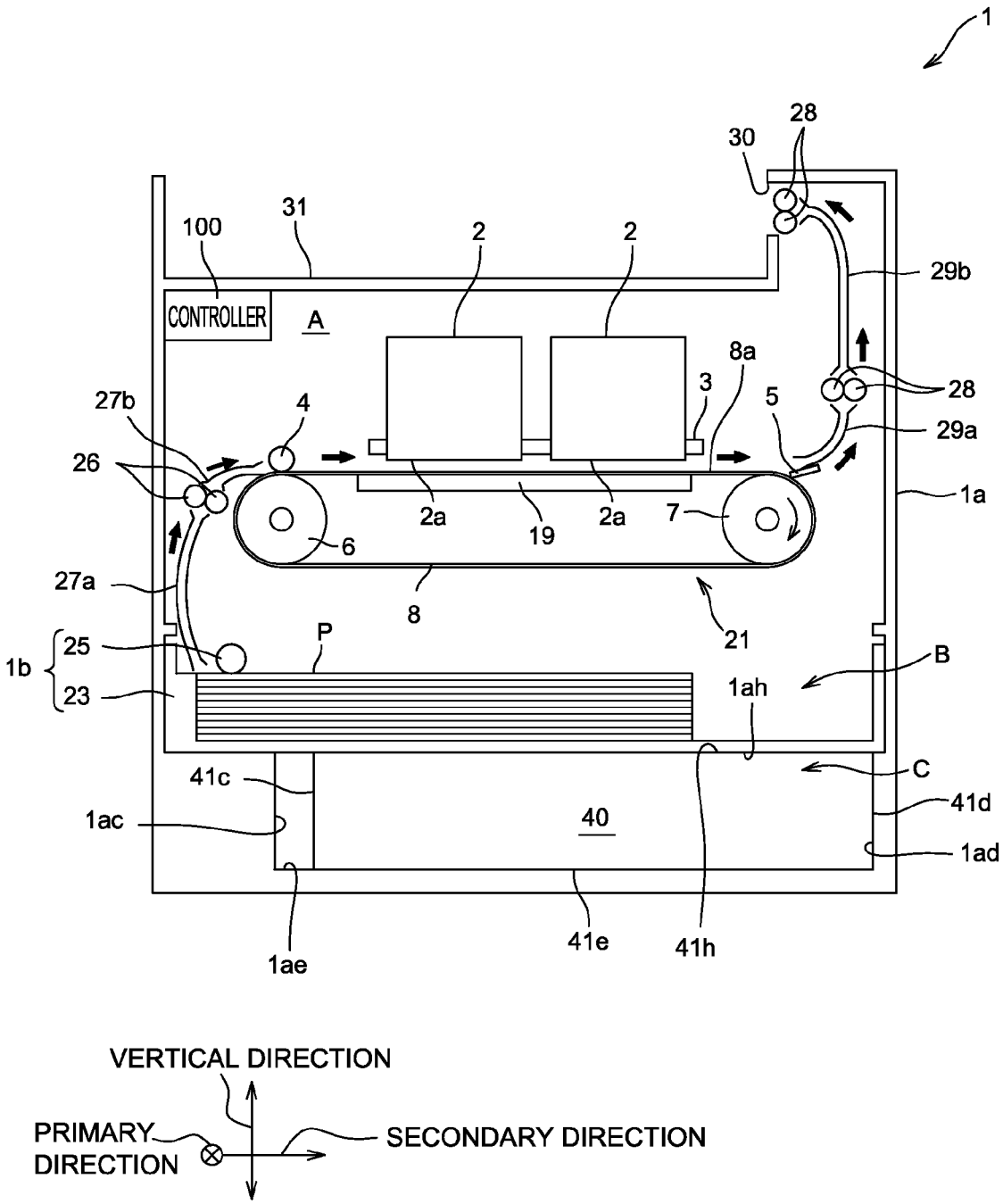
FIG. 2 is a schematic side view depicting an internal structure of a printer according to an embodiment of the invention.

Referring to FIG. 1, a recording apparatus, e.g., an inkjet printer 1, may comprise a main unit and a cartridge 40 configured to be mounted to the main unit. The main unit of the printer 1 may comprise a housing 1*a* having substantially a rectangular parallelepiped shape. A sheet discharge portion 31 may be disposed at the top of the housing 1*a*. The housing 1*a* may have three openings 10*d*, 10*b*, and 10*c* formed in one of its vertically extending outer surfaces, e.g., a front surface of the printer 1. The openings 10*d*, 10*b*, and 10*c* may be vertically aligned in this order from top to bottom when the printer 1 is oriented vertically, as depicted in FIG. 1. A sheet feed unit 1*b* and a cartridge 40, as depicted in FIG. 2, may be removably inserted into the housing 1*a* through the openings 10*b* and 10*c*, respectively. The main unit of the printer 1 may comprise a door 1*d* fitted into the opening 10*d* and configured to pivot about a horizontal axis at a lower end of the door 1*d*. The door 1*d* may pivot to selectively cover and expose the opening 10*d*. As depicted in FIG. 2, the door 1*d* may be disposed with an interior surface facing a transport unit 21 interior to the printer 1 in a primary direction. The printer 1 may further comprise a cover 1*c* disposed in the opening 10*c* and configured to pivot about a horizontal axis at a lower end of the cover 1*c*. When the cover 1*c* is closed while the cartridge 40 is mounted in the inside of the housing 1*a*, the cover 1*c* may prevent the cartridge from falling from the housing 1*a* of the printer 1.

Referring to FIG. 2, an interior of the housing 1*a* may be divided into spaces A, B, and C in the vertical direction in this order from top to bottom, as shown in FIG. 2. Two heads 2, the transport unit 21, and a controller 100 may be disposed in the space A. The heads 2 may be configured to discharge black ink and pretreatment liquid, respectively. The black ink and the pretreatment liquid may be collectively referred to as liquid, respectively. The transport unit 21 may be configured to transport sheets P. The controller 100 may be configured to control operations of the components of the printer 1. The sheet feed unit 1*b* may be disposed in the space B, and the cartridge 40 may be disposed in the space C. Thus, the space C may be a portion that receives the cartridge 40, e.g., a cartridge receiving portion, in the main unit. The space C may comprise portions other than the cartridge 40 mounted in the printer 1, of the printer 1. A sheet transport path, along which sheets P may be transported, may be formed in the housing 1*a*. The sheet transport path may extend from the sheet feed unit 1*b* toward the sheet discharge portion 31, as indicated by the bold arrows in FIG. 2.

The controller 100 may comprise a central processing unit (CPU), a read-only memory (ROM), a random access memory (RAM), such as a nonvolatile RAM, and an interface. The ROM may be configured to store programs to be executed by the CPU and various fixed data. The RAM may be configured to temporarily store data, e.g., image data, for the CPU to execute programs. The controller 100 may be configured to transmit and receive data to and from a memory 141, e.g., as depicted in FIG. 12, and Hall devices 71, e.g., Hall effect sensors, of the cartridge 40. Further, the controller 100 may be configured to transmit and receive data to and from an external device, e.g., a personal computer connected to the printer 1, via the interface.

Figure 9:
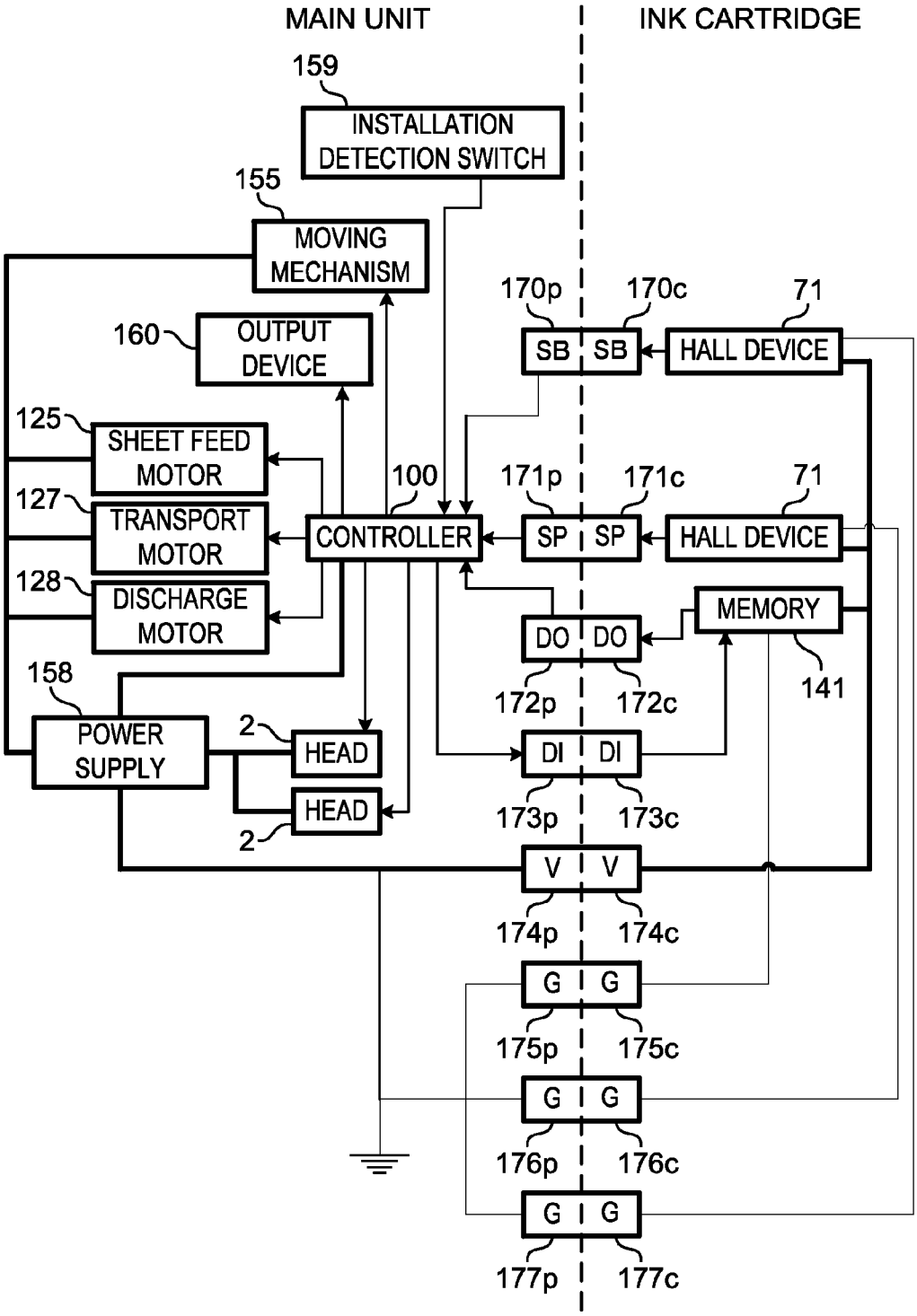
FIG. 9 is a block diagram depicting an electrical configuration of a cartridge and a main unit of a printer according to an embodiment of the invention.

The sheet feed unit 1*b* may comprise a tray 23 and a roller 25. The tray 23 may be configured to be detachably attached to the housing 1*a* along the primary direction. The tray 23 may have a substantially box shape and may open upward. The tray 23 may be configured to accommodate sheets P of various sizes. As depicted in FIG. 9, a sheet feed motor 125 that may be controlled by the controller 100, may drive the roller 25, which may be configured to feed the topmost sheet P from the tray 23 when driven by the roller 25. The sheet P fed by the roller 25 may be sent to the transport unit 21 while being guided by guides 27*a* and 27*b* and while being nipped by a pair of feed rollers 26.

The transport unit 21 may comprise two rollers 6 and 7 and an endless transport belt 8. The transport belt 8 may be wound around the rollers 6 and 7. The roller 7 may be a driving roller configured to rotate in the clockwise direction, as depicted in FIG. 2. Specifically, referring to FIG. 9, when a shaft of the roller 7 is driven by a transport motor 127 controlled by the controller 100, the roller 7 may receive a driving force from the transport motor 127. Referring to FIG. 2, the roller 6 may be a driven roller configured to rotate in the clockwise direction, as depicted in FIG. 2, along with the running of the transport belt 8 caused by the rotation of the roller 7. A platen 19 having a substantially rectangular parallelepiped shape may be disposed within the loop of the transport belt 8. An outer surface 8*a* of the transport belt 8 at an upper portion of the loop may face lower surfaces 2*a* of the heads 2, and may extend substantially in parallel with the lower surfaces 2*a* with a gap formed between the lower surfaces 2*a* and the outer surface 8*a*. The platen 19 may support an inner surface of the transport belt 8 at the upper portion of the loop of the transport belt 8. The lower surface 2*a* of each head 2 may be a discharge surface where a plurality of discharge nozzles for discharging ink may be formed. A silicone layer having a low adhesive property may be formed on the outer surface 8*a* of the transport belt 8. A pressing roller 4 may press the sheet P, which is fed out from the sheet feed unit 1*b* toward the transport unit 21, against the outer surface 8*a* of the transport belt 8. While the outer surface 8*a* of the transport belt 8 holds the sheet P by the adhesive property of the outer surface 8*a*, the transport belt 8 may transport the sheet P a secondary direction as indicated by the bold arrows in FIG. 2.

The primary direction may be a direction that a longer side of the lower surface 2*a* of the head 2 may extend, and may be perpendicular to a direction that a surface of the drawing sheet of FIG. 2 may extend. The secondary direction may be perpendicular to the primary direction. Each of the primary direction and the secondary direction may be a horizontal direction.

As shown in FIG. 2, when the sheet P held on the outer surface 8*a* of the transport belt 8 passes below the heads 2, the controller 110 may control the heads 2 to discharge one or both of the black ink and the pretreatment liquid toward an upper surface of the sheet P from the lower surfaces 2*a* to form an image on the sheet P. A separating plate 5 may be configured to separate the sheet P from the outer surface 8*a* of the transport belt 8 when the sheet P is fed to the separating plate 5. The sheet P may be transported upward while being guided by guides 29*a*, 29*b* and while being nipped by two pairs of transport rollers 28, and may be discharged onto the sheet discharge portion 31 through an opening 30 formed at the top of the housing 1*a*. Referring to FIG. 9, one roller of each transport roller pair 28 may be driven by a feed motor 128 controlled by the controller 100.

The pretreatment liquid may have one or more of a property of improving a density of ink discharged onto the sheet P, a property of preventing the occurrence of ink blurring or strike-through, e.g., the penetration of ink through the sheet P that is being recorded, a property of improving color reproduction, a quick dry property of ink, and a property of preventing the occurrence of wrinkles or curls on the sheet P after ink is discharged on the sheet P. For example, liquid containing a polyvalent salt, e.g., cationic high polymer or a magnesium salt, may be used as the pretreatment liquid. The head 2 for discharging the pretreatment liquid may be disposed upstream from the head 2 for discharging the black ink in the transport direction.

As depicted in FIG. 2, each head 2 may be a line type head elongated in the primary direction and may have a substantially rectangular parallelepiped shape. The heads 2 may be aligned in the secondary direction with a predetermined pitch and may be supported by the housing 1*a* via a frame 3. A joint may be disposed at an upper surface of each head 2 for receiving a flexible tube. A plurality of discharge nozzles may be formed in the lower surface 2*a* of each head 2. A flow path may be formed inside each head 2, such that liquid, which is supplied from a corresponding reservoir 42 of the cartridge 40 via a corresponding tube and a corresponding joint, may flow to corresponding discharge nozzles.

Figure 4:
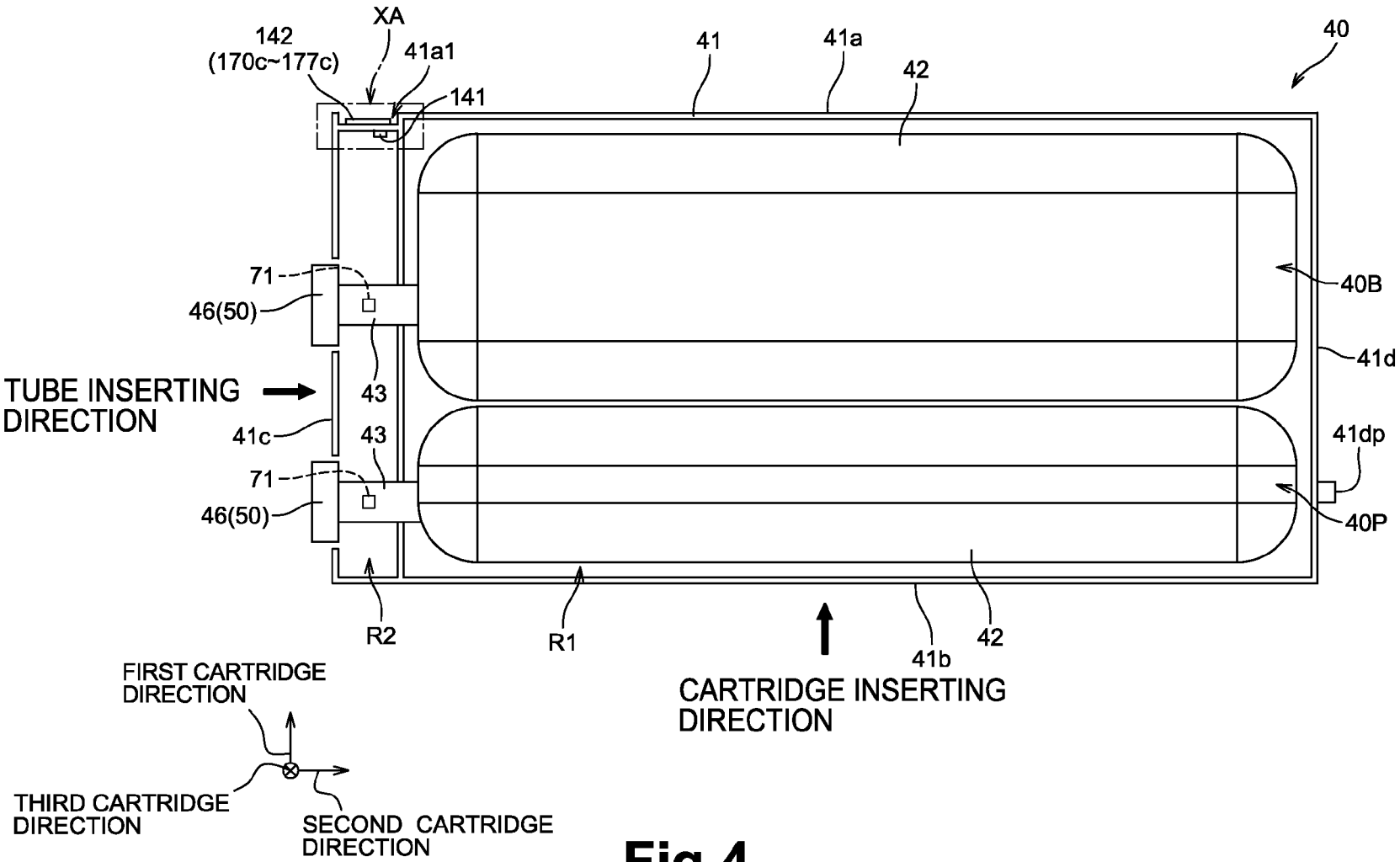
FIG. 4 is a schematic plan view depicting an internal structure of the cartridge of FIG. 3D according to an embodiment of the invention.

Referring to FIG. 4, the cartridge 40 may comprise the reservoirs 42 for storing black ink and pretreatment liquid, respectively. The liquid stored in each reservoir 42 of the cartridge 40 may be supplied to the corresponding head 2 via the corresponding flexible tube and the corresponding joint. The cartridge 40 may be configured to be attachable to and detachable from the housing 1*a* of the printer 1 along the primary direction. Therefore, an empty cartridge 40 may be removed from the housing 1*a* of the printer 1 and be replaced with a new cartridge 40, which may be attached to the housing 1*a* of the printer 1.

Figure 3B:
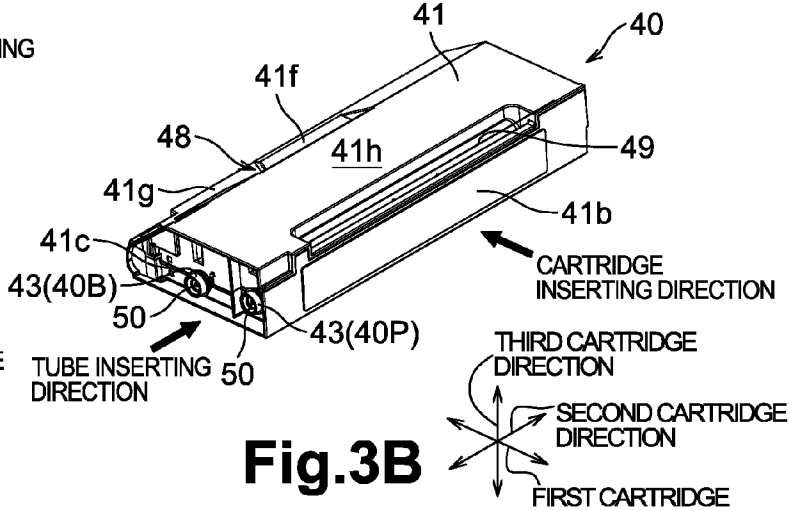
FIG. 3B is another perspective side view depicting the cartridge of FIG. 3A according to an embodiment of the invention.
Figure 3D:
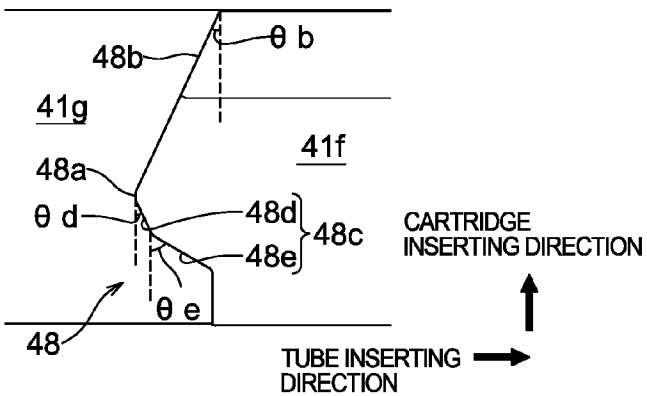
FIG. 3D is an enlarged view depicting an area IIID in FIG. 3C according to an embodiment of the invention.
Figure 3A:
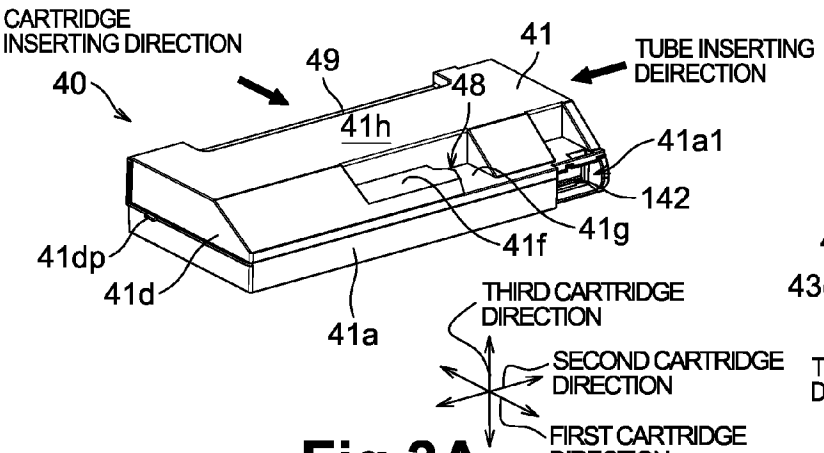
FIG. 3A is a perspective side view depicting a cartridge according to an embodiment of the invention.

Referring to FIGS. 3A-4, the cartridge 40 may comprise a housing 41, a black ink unit 40B, a pretreatment liquid unit 40P, and a substrate 142. Each of the black ink unit 40B and the pretreatment liquid unit 40P may comprise the reservoir 42 and an ink outlet tube 43. The black ink unit 40B and the pretreatment liquid unit 40P may have substantially the same structure with different reservoir size, as depicted in FIG. 4.

As depicted in FIGS. 3A and 3B, the housing 41 may have a substantially rectangular parallelepiped shape. As depicted in FIG. 4, the interior of the housing 41 may be divided into two chambers R1 and R2. The reservoirs 42 of the black ink unit 40B and the pretreatment liquid unit 40P may be disposed in the chamber R1. The ink outlet tubes 43 of the black ink unit 40B and the pretreatment liquid unit 40P may be disposed in the chamber R2.

Each reservoir 42 may comprise a bag for storing liquid therein and may have an opening to which one end of the ink outlet tube 43 is connected. The reservoir 42 of the black ink unit 40B may be configured to store black ink. The reservoir 42 of the pretreatment liquid unit 40P may be configured to store pretreatment liquid.

As depicted in FIGS. 3B and 4, the ink outlet tube 43 may define an ink outlet path for discharging the liquid stored in the reservoir 42 to the head 2. The other end of the ink outlet tube 43 may protrude from the housing 41 of the cartridge 40. The ink outlet tube 43 may have an opening at a side opposite to the reservoir 42. A plug 50 may comprise an elastomeric material, e.g., rubber, and may be disposed in a compressed state at the other end of the ink outlet tube 43, such that the plug 50 may close the opening of the ink outlet path. A cap 46 may be disposed at the other end of the ink outlet tube 43 and outside the plug 50. The cap 46 may have an opening formed therethrough substantially at its center portion. A surface of the plug 50 may be partially exposed through the opening of the cap 46.

Figure 3C:
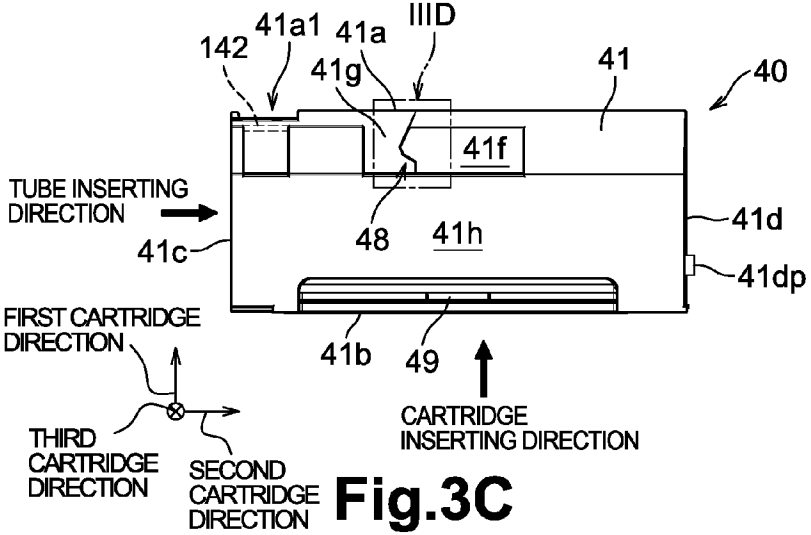
FIG. 3C is a plan view depicting the cartridge of FIG. 3A according to an embodiment of the invention.

The housing 41 may comprise surfaces 41*a*-41*h*. The front surface 41*a* and the rear surface 41*b* may extend substantially parallel to each other and substantially perpendicular to a direction in which the cartridge 40 may be inserted into the space C, e.g., a cartridge inserting direction. The front surface 41*a* and the rear surface 41B may be separated from each other with respect to the cartridge inserting direction. The rear surface 41*b* may be disposed upstream of the front surface 41*a* with respect to the cartridge inserting direction. The side surfaces 41*c* and 41*d* may extend substantially parallel to each other and substantially perpendicular to a direction in which the hollow tube 153 may be inserted into the ink outlet tube 43, e.g., a tube inserting direction. That is the side surfaces 41*c* and 41*d* may extend substantially perpendicular to the front and rear surfaces 41*a* and 41*b*, respectively. The side surfaces 41*c* and 41*d* may be separated from each other with respect to the tube inserting direction and disposed between the front surface 41*a* and the rear surface 41*b* with respect to the cartridge inserting direction. The ink outlet tubes 43 may be disposed at the side surface 41*c* of the housing 41, as depicted in FIG. 3B. The side surface 41*d* may comprise a protrusion 41*dp* at a position near an upstream end of the side surface 41*d* with respect to the cartridge inserting direction, as depicted in FIGS. 3A, 3C, and 4. As depicted in FIG. 2, the upper surface 41*h*, e.g., fourth surface, and the lower surface 41*e*, e.g., fifth surface, may extend substantially parallel to each other and substantially perpendicular to a third cartridge direction, e.g., a fifth direction. Thus, the upper and lower surfaces 41*h* and 41*e* may extend substantially perpendicular to the surfaces 41*a*-41*d*, respectively, and be separated from each other with respect to the third cartridge direction. The upper and lower surfaces 41*h* and 41*e* may be disposed between the front surface 41*a* and the rear surface 41*b* with respect to the cartridge inserting direction and between the side surface 41*c* and the side surface 41*d* with respect to the tube inserting direction. The upper surface 41*h* may be contiguous to an upper end of the side surface 41*c* and extend along the tube inserting direction. The lower surface 41*e* may be contiguous to a lower end of the side surface 41*c* and extend along the tube inserting direction. The front surface 41*a* may contiguous to a downstream end of the side surface 41*c* with respect to the cartridge inserting direction and extend along the tube inserting direction. The surfaces 41*f* and 41*g* may extend substantially parallel to the upper and lower surfaces 41*h* and 41*e*. The surfaces 41*f* and 41*g* may be disposed between the upper surface 41*h* and the lower surface 41*e* with respect to the third cartridge direction and between the upper surface 41*h* and the front surface 41*a* with respect to the cartridge inserting direction. The surfaces 41*f* and 41*g* may be separated from the lower surface 41*e* and opposite to the lower surface 41*e* with respect to the third cartridge direction. The surface 41*f* may be disposed farther than the surface 41*g* from the lower surface 41*g* with respect to the third cartridge direction. The surfaces 41*f* and 41*g* may not overlap with each other in the third cartridge direction. When the cartridge 40 is mounted in the printer 1, a first cartridge direction, e.g., first direction, may be aligned with the primary direction, a second cartridge direction may be aligned with the secondary direction, and the third cartridge direction may be aligned with the vertical direction.

The cartridge inserting direction may be parallel to the primary direction, and the tube inserting direction may be parallel with the secondary direction. The cartridge inserting direction may be perpendicular to the tube inserting direction.

Figure 5:
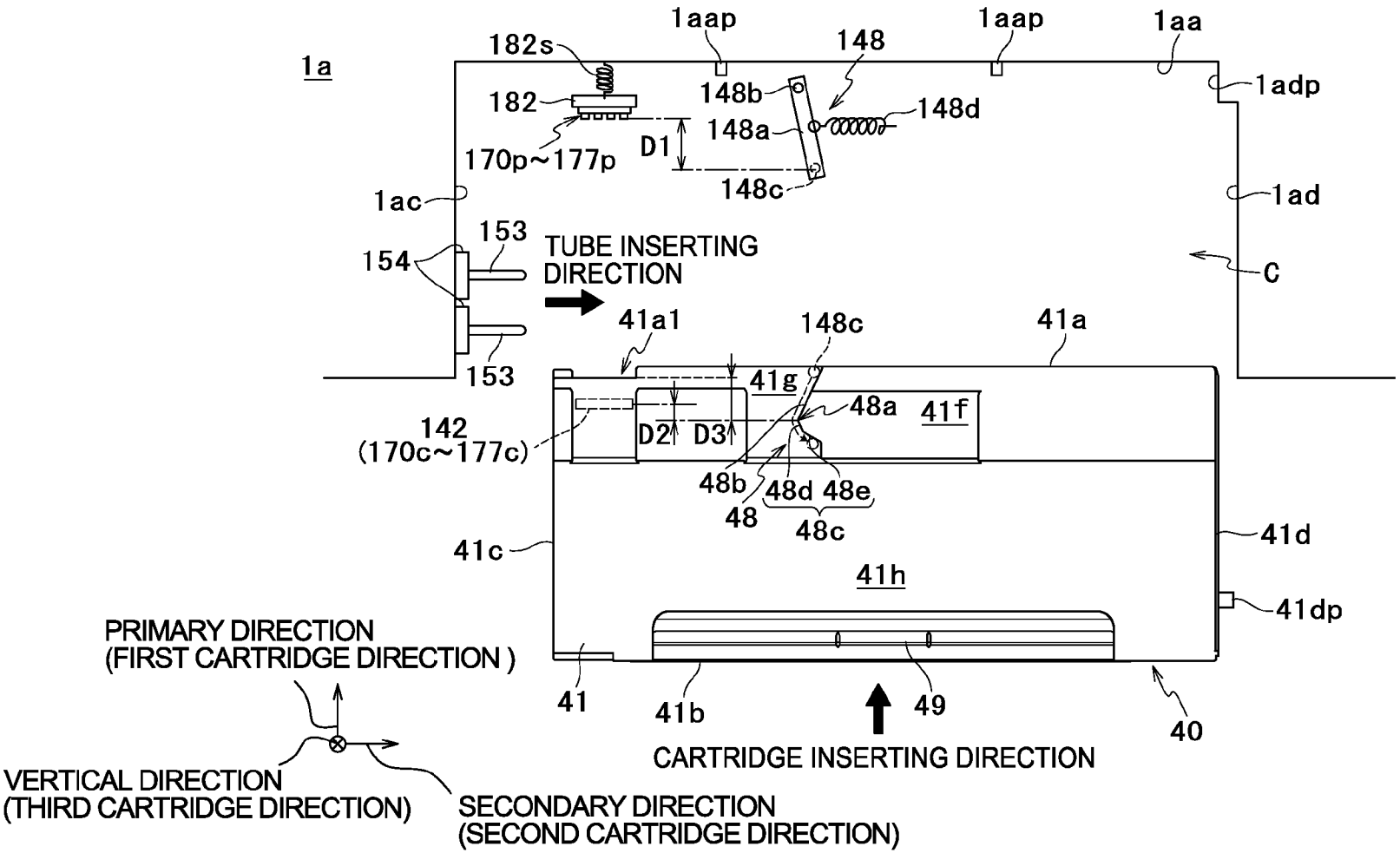
FIG. 5 is a schematic plan view depicting a portion defining a cartridge receiving portion of a printer according to an embodiment of the invention.

The housing 41 may further comprise an engagement portion 48 and a hand well portion 49. The engagement portion 48 may be configured to be engaged with a roller 148*c* of a locking unit 148, as depicted in FIG. 5. As depicted in FIG. 3D, the engagement portion 48 may comprise a surface that may connect the surfaces 41*f* and 41*g* of the housing 41 to each other and extend perpendicular to the surfaces 41*f* and 41*g*. The surface constituting the engagement portion 48 may comprise a portion 48*a* and surfaces 48*b*-48*e*. In a plane extending perpendicular to the third cartridge direction, the surface 48*b*, e.g., third surface, may extend along a direction including a component in a direction opposite to the cartridge inserting direction, e.g., a backward component in FIG. 3D, and a component in a direction opposite to the tube inserting direction, e.g., a fourth direction or a leftward component in FIG. 3D, and each surface 48*d* and 48*e* may extend along a direction including a component in the direction opposite to the cartridge inserting direction e.g., a backward component in FIG. 3D, and a component in the tube inserting direction, e.g., a rightward component in FIG. 3D. The surface 48*c* may comprise the surfaces 48*d* and 48*e*. The surface 48*d* may be contiguous to the portion 48*a*, and the surface 48*e*, e.g., second surface, may be contiguous to the surface 48*d*. The surface 48*c* may be disposed closer to the front surface 41*a* than the rear surface 41*b* with respect to the cartridge inserting direction. Further, the surface 48*c* may be disposed substantially in the middle of the side surface 41*c* and the side surface 41*d* and substantially in the middle of the upper surface 41*h* and the lower surface 41*e*. The surface 48*e* may face a direction, e.g., second direction, which forms an obtuse angle with the cartridge insertion direction. The surface 48*b* may face a direction, e.g., third direction, which forms an acute angle with the cartridge insertion direction. The portion 48*a* may be a border between the surface 48*b* and the surface 48*d* and may also be a downstream end of the surface 48*c* with respect to the cartridge inserting direction. The surfaces 48*b*, 48*d*, and 48*e* may form angles of θb, θd, and θe, respectively, with respect to the cartridge inserting direction. The relationship among the angles θb, θd, and θe may satisfy $\theta d<\theta b<\theta e<90°$. The surface 48*b* does not overlap with the substrate 142 in the cartridge insertion direction.

The hand well portion 49, e.g., a holding portion, may be a recessed portion configured to allow the user to insert his/her hand therein. The hand well portion 49 may be defined in a corner that may be formed by the upper surface 41*h* and the rear surface 41*b* and elongated along an upstream side of the upper surface 41*h* with respect to the cartridge inserting direction.

Figure 10A:
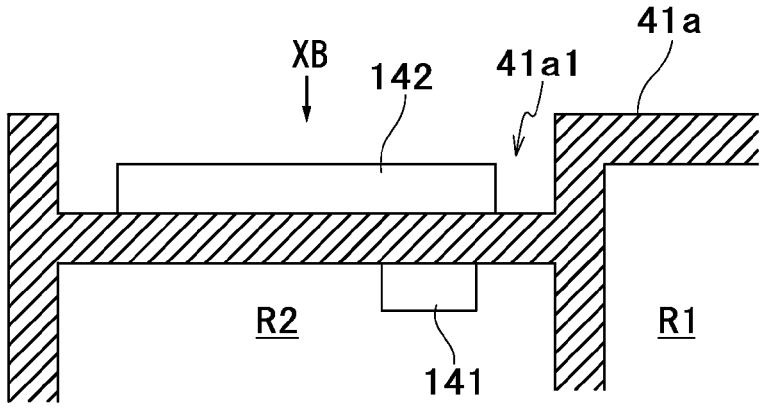
FIG. 10A is an enlarged view depicting an area XA in FIG. 4 according to an embodiment of the invention.
Figure 10B:
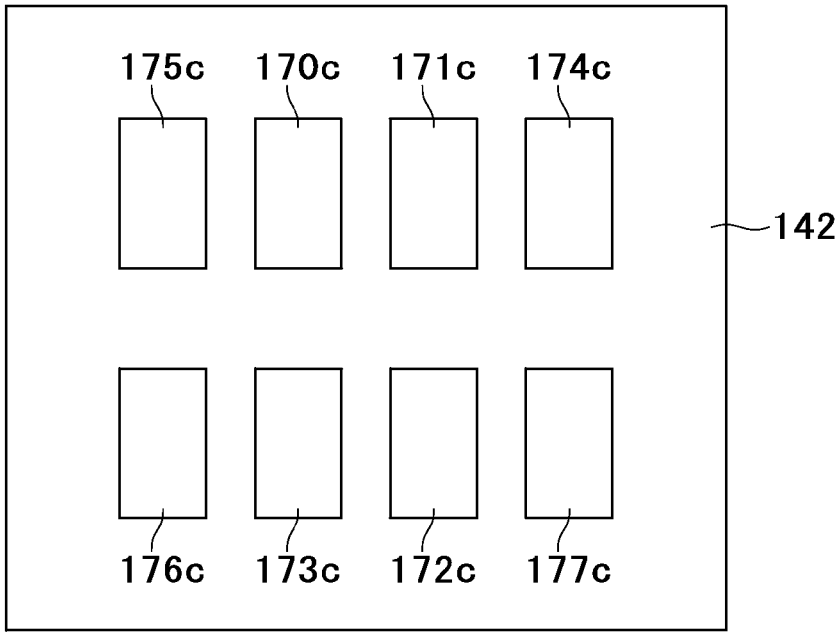
FIG. 10 B is a plan view of a substrate of a cartridge viewed in a direction of arrow XB in FIG. 10A according to an embodiment of the invention.
Figure 10B:
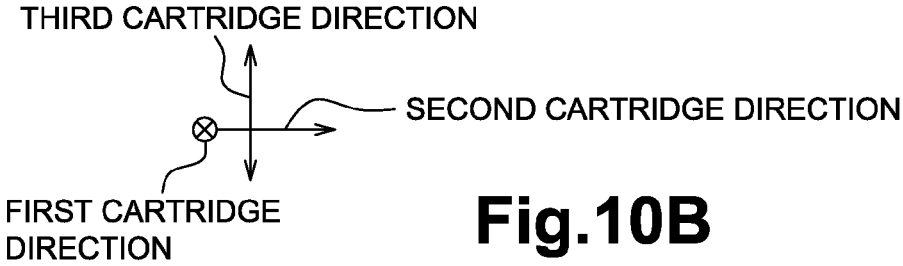

The front surface 41*a* may have a recessed portion 41*a*1 at an upstream part of the front surface 41*a* with respect to the tube inserting direction. The recessed portion 41*a*1 may be opposite to the chamber R2 with respect to the first cartridge direction, as depicted in FIG. 4. The substrate 142 may be disposed in an interior of the recessed portion 41*a*1. The substrate 142 may have a substantially rectangular plate shape and comprise the memory 141 on one surface thereof and a plurality of terminals, e.g., eight electrical terminals, terminals 170*c*-177*c*, on the other surface thereof, e.g., first surface, as depicted in FIGS. 10A and 10B. The terminals 170*c*-177*c* may be exposed to the outside of the cartridge 40 via the recessed portion 41*a*1. Each terminal 170*c*-177*c* may comprise a contact surface that contact a corresponding one of the terminals 170*p*-177*p*. The contact surface of each terminal 170*c*-177*c* may extend along the second cartridge direction and the third cartridge direction. The surface 48*c* may be disposed such that the surface 48*c* may be disposed higher than the terminals 170*c*-177*c* when the cartridge 40 is installed in the space C.

As shown in FIG. 9, the sensor signal output terminal (SB) 170*c* may be electrically connected with the Hall device 71 of the black ink unit 40B. The sensor signal output terminal (SP) 171*c* may be electrically connected with the Hall device 71 of the pretreatment liquid unit 40P. The data output terminal (DO) 172*c* and the data input terminal (DI) 173*c* may be electrically connected to the memory 141. The electric power input terminal (V) 174*c* may be electrically connected with the memory 141, the Halt device 71 of the pretreatment liquid unit 40P, and the Hall device 71 of the black ink unit 40B. The ground terminals (G) 175*c*, 176*c*, and 177*c* may be electrically connected with the memory 141, the Hall device 71 of the pretreatment liquid unit 40P, and the Hall device 71 of the black ink unit 40B, respectively. Electrical connections between the terminals 170*c*, 171*c*, 174*c*, 175*c*, 176*c*, and 177*c* and the respective Hall devices 71 may be established by wiring using flexible cables. Electrical connections between the terminals 172*c*, 173*c*, 174*c*, 175*c*, 176*c*, and 177*c* and the memory 141 may be established via conductive members that may be filled in through holes formed in the substrate 142.

As depicted in FIG. 4, the Hall device 71 may be disposed on an upper wall of the ink outlet tube 43, and a magnet may be disposed on a lower wall of the ink outlet tube 43. The magnet may produce a magnetic field, and Hall device 71 may detect a magnetic field of the magnet, convert the detected magnetic field to an electric signal, and generate the electric signal. A valve may be disposed inside the ink outlet tube 43, e.g., outlet portion. The valve may be configured to move between an open position, at which the valve may open the ink outlet path disposed inside the ink outlet tube 43, and a closed position, at which the valve may close the ink outlet path. The Hall device 71 may generate a signal having a magnitude corresponding to a position of the valve inside the ink outlet tube 43. The valve and the plug 50 may be aligned along a direction in which liquid may flow in the ink outlet tube 43.

The memory 141 may comprise an electrically erasable programmable ROM ("EEPROM") or the like, and may store data relating to the cartridge 40. More specifically, the memory 141 may prestore an amount of liquid remaining in each reservoir 42 and sensor output values, e.g., output values received from each Hall device 71. The controller 100 may be configured to read the data from the memory 141 while the cartridge 40 is mounted in the space C of the printer 1. In addition, while the cartridge 40 is mounted in the printer 1, the controller 100 may be configured to write various data in the memory 141, e.g., the amount of liquid remaining in each reservoir 42.

Referring to FIG. 5, the space C, e.g., the cartridge receiving portion, may be defined by walls 1*aa*, 1*ac*, 1*ad*, 1*ae*, and 1*ah* of the housing 1*a*. The front wall 1*aa* may extend substantially perpendicular to the cartridge inserting direction. The front wall 1*aa* may be disposed to face the front surface 41*a* of the cartridge 40 when the cartridge 40 is installed in the space C. A substrate 182 may be disposed on the front wall 1*aa* and supported by a spring 182*s*. A plurality of protrusions, e.g., two protrusions 1*aap*, may protrude from the front wall 1*aa* at respective positions separated from each other with respect to the tube inserting direction. The side walls 1*ac* and 1*ad* may extend substantially parallel to each other and substantially perpendicular to the cartridge inserting direction. The side walls 1*ac* and 1*ad* may be separated from each other with respect to the tube inserting direction. The side walls 1*ac* and 1*ad* may be disposed to face the side surfaces 41*c* and 41*d*, respectively, when the cartridge 40 is installed in the space C, e.g., receiving portion. The plurality of hollow tubes 153, e.g., needles, and a plurality of support member, e.g., two support members 154, may be disposed on the side wall 1*ac*. The hollow tubes 153 may be provided for the black ink unit 40B and the pretreatment liquid unit 40P, respectively. The support members 154 may be configured to hold the hollow tubes 153, respectively. The support members 154 may be configured to move in the tube inserting direction and in a direction opposite to the tube inserting direction with respect to the housing 1*a* of the printer 1 by a moving mechanism 155, as depicted in FIG. 9. The hollow tubes 153 may be configured to be disposed selectively in a removed position, as depicted in FIG. 6C, and an inserted position, as depicted in FIG. 6D, in accordance with the movement of the support members 154. When the hollow tubes 153 are disposed in the removed position, the hollow tubes 153 may be removed from the respective ink outlet tubes 43 of the reservoirs 42. When the hollow tubes 153 are disposed in the inserted position, the hollow tubes 153 may be inserted into the respective ink outlet tubes 43 of the reservoirs 42. The hollow tubes 153 corresponding to the black ink unit 40B and the pretreatment liquid unit 40P, respectively, may be in fluid communication with the head 2 for discharging the black ink and the head 2 for discharging the pretreatment liquid, respectively, via respective flexible tubes and respective joints. The side wall 1*ad* may have a projecting part 1*adp* at a downstream end thereof with respect to the cartridge inserting direction. As depicted in FIG. 2, the upper wall 1*ah* and the lower wall 1*ae* may extend substantially parallel to the walls 1*aa*, 1*ac*, and 1*ad*, respectively, and each of the upper wall 1*ah* and the lower wall 1*ae* may extend between the side wall 1*ac* and the side wall 1*ad*. The upper wall 1*ah* and the lower wall 1*ae* may be separated from each other with respect to the third cartridge direction.

The substrate 182 may have substantially the same size as the substrate 142. The substrate 182 may be disposed to face the substrate 142 of the cartridge 40 when the cartridge 40 is installed in the space C, as depicted in FIGS. 6A-6D. A plurality of terminals, e.g., eight terminals 170*p*-177*p*, may be provided on one surface of the substrate 182 such that the terminals 170*p*-177*p* may contact the corresponding terminals 170*c*-170*c* when the cartridge 40 is installed in the space C. As depicted in FIG. 9, the sensor signal receiving terminal (SB) 170*p*, the sensor signal receiving terminal (SP) 171*p*, the data receiving terminal (DO) 172*p*, and the data transmitting terminal (D1) 173*p* may be electrically connected with the controller 100. The electric power output terminal (V) 174*p* may be electrically connected with a power supply 158 provided in the housing 1*a*. The ground terminals 175*p*, 176*p*, and 177*p* may be grounded.

One end of the spring 182*s* may be fixed to the other surface of the substrate 182 and the other end of the spring 182*s* may be fixed to the front wall 1*aa*. Thus, the substrate 182 may be held by the one end of the spring 182*s*. Therefore, the substrate 182 may be configured to move within a plane extending parallel to the secondary direction and the vertical direction.

Figure 11:
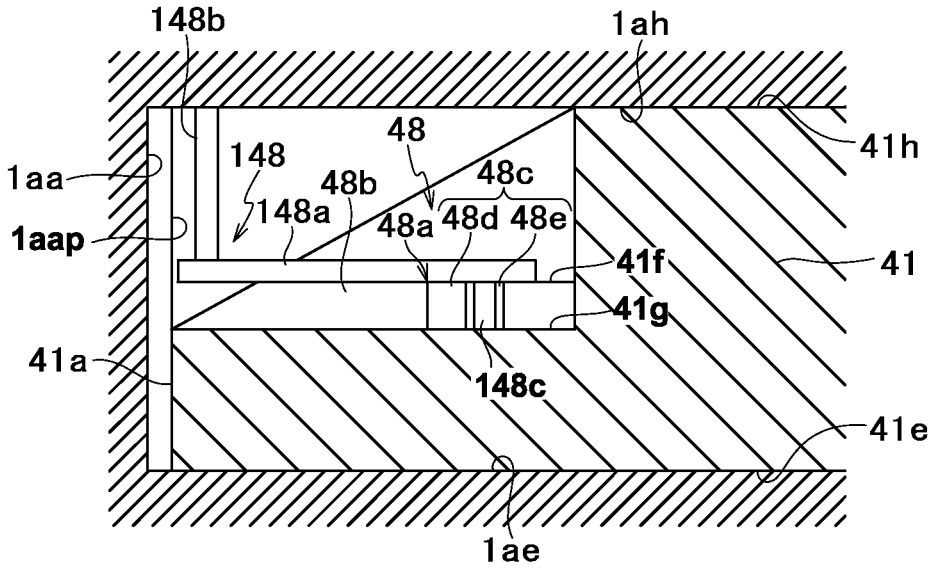
FIG. 11 is a sectional view taken along line XI-XI of FIG. 7C according to an embodiment of the invention.

As depicted in FIG. 5, the locking unit 148 may be disposed in the space C. The locking unit 148 may comprise a lever 148*a*, a shaft 148*b*, a roller 148*c*, e.g., contact portion, and a spring 148*d*. As depicted in FIG. 11, the shaft 148*b* may be fixed to the upper wall 1*ah* and extend downward from the upper wall 1*ah* along the vertical direction. The lever 148*a* may be held by a lower end of the shaft 148*b*. The lever 148*a* may be configured to rotate about the shaft 148*b* within a plane extending perpendicular to the vertical direction. One end of the spring 148*d* may be fixed to one side of the lever 148*a* and the other end of the spring 148*d* may be fixed to the housing 1*a* of the printer 1. The roller 148*c* may be rotatably held by a lower surface of a free end, which may be an end opposite to the fixed end of the lever 148*a*, which is fixed to the shaft 148. The roller 148*c* may be configured to move within a plane extending perpendicular to the vertical direction. The roller 148*c* may be disposed substantially in the middle portion of the side wall 1*ac* and the side wall 1*ad*, as depicted in FIG. 5, and substantially in the middle portion of the upper wall 1*ah* and the lower wall 1*ae*, as depicted in FIG. 11.

With respect to the cartridge inserting direction, a distance D1 between a contact portion of the roller 148*c*, which may contact the surface 48*c* of the engagement portion 48, and the surfaces of the terminals 170*p*-177*p* may be greater than a distance D2 between the portion 48*a* of the engagement portion 48 and the surfaces of the terminals 170*c*-177*c*. Further, with respect to the cartridge inserting direction, the distance D1 may be less than a distance D3 between the portion 48*a* of the engagement portion 48 and a downstream end of a guide portion with respect to the cartridge inserting direction.

Referring to FIGS. 6A-9, the cartridge 40 may be installed into the space C of the printer 1 to establishment fluid communication between the cartridge 40 and the heads 2. In FIG. 9, electric power supply lines may be indicated by thick lines and signal lines may be indicated by thin lines.

Figure 8:
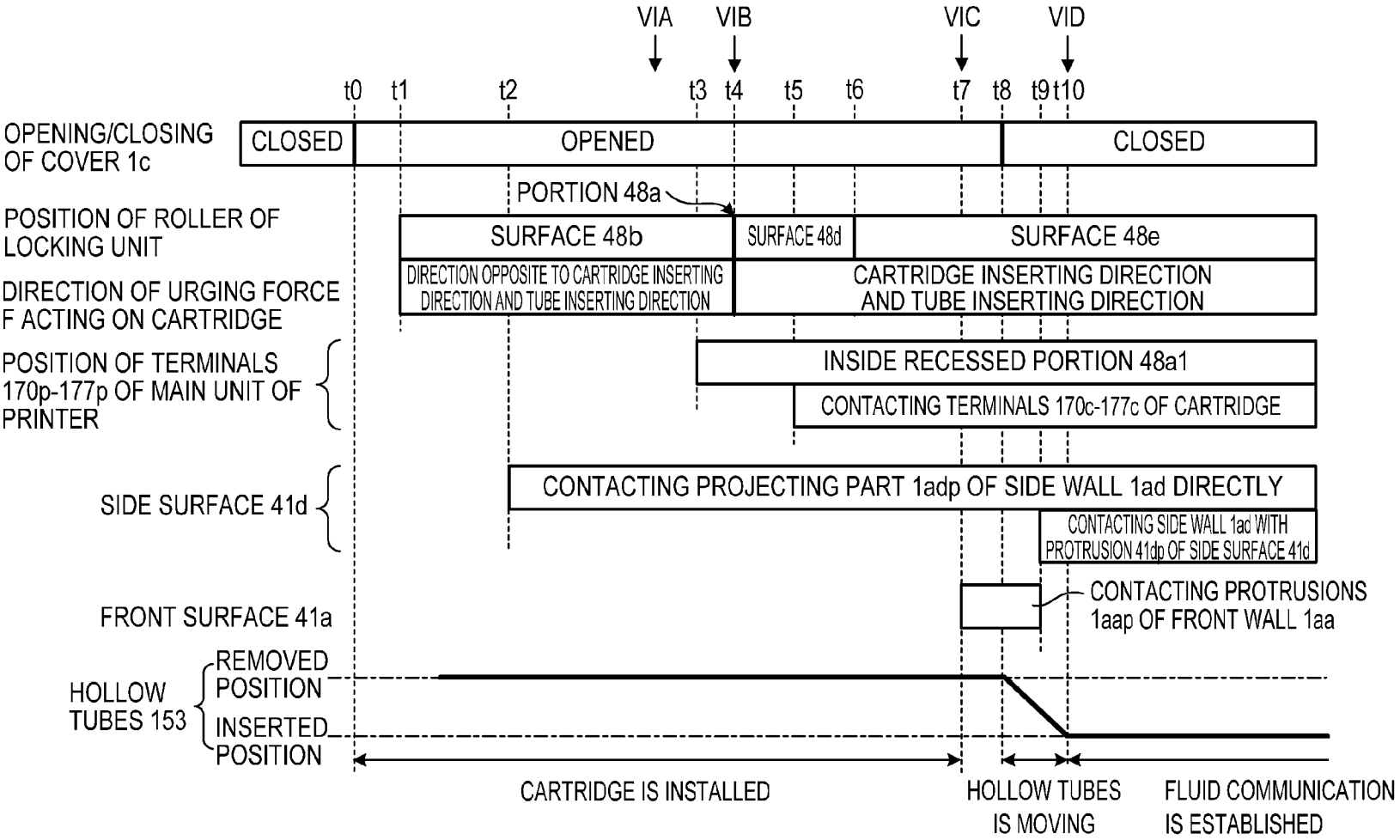
FIG. 8 is a timing diagram depicting a state of each portion of a printer during a process of installing a cartridge in a cartridge receiving portion of the printer according to an embodiment of the invention.

During installation of the cartridge 40 into the space C of the housing 1*a* of the printer 1, the user of the printer 1 first may open the cover 1*c*, as depicted in FIG. 1, of the printer 1, e.g., at timing t0 in FIG. 8. Then, the user may hold the hand well portion 49 of the cartridge 40 with one hand and insert, the cartridge 40 into the space C of the printer 1, as depicted in FIG. 6A. FIGS. 6A-6D may depict conditions of the printer 1 and the cartridge 40 during timings VIA, VIB, VIC, and VID, respectively, as depicted in FIG. 8.

When the cartridge 40 is inserted into the space C, first, the roller 148*c* may contact the surface 48*b* of the engagement portion 48 of the cartridge 40, e.g., at timing t1 in FIG. 8. Then, the roller 148*c* may slide over the surface 48*b* toward the portion 48*a*, as depicted by a dashed line in FIG. 5. While the roller 148*c* slides over the surface 48*b*, first, the side surface 41*d* of the cartridge 40 may contact the projecting part

1*adp* of the side wall 1*ad*, e.g., at timing t2 in FIG. 8. After the timing t2, the cartridge 40 may move along the cartridge inserting direction while the side surface 41*d* of the cartridge 40 may slide over the projecting part 1*adp*, e.g., the housing 41 of the cartridge 40 may be guided by the projecting part 1*adp*. After the timing t2, a wall defining the recessed portion 41*a*1, e.g., the guide portion, may contact one or both of side surfaces of the substrate 182 of the printer 1 to allow the substrate 182 to move in a direction in which the substrate 182 may approach the substrate 142 disposed in a plane extending parallel to the secondary direction and the vertical direction. Thus, substrate 182 holding the terminals 170*p*-177*p* may be guided by the guide portion and may enter the recessed portion 41*a*1, e.g., at timing t3 in FIG. 8. As depicted by the dashed line in FIG. 5, the roller 148*c* then may contact the portion 48*a* of the engagement portion 48, e.g., at timing t4 in FIG. 8, and then may pass the portion 48*a* and contact the surface 48*d*. The roller 148*c* may further slide over the surface 48*d* toward the surface 48*e*. While the roller 148*c* moves in the above-described path, the terminals 170*p*-177*p* may face and contact the corresponding terminals 170*c*-177*c* with respect to the cartridge inserting direction, e.g., at timing t5 in FIG. 8.

Thus, electrical connections between the terminals 170*c*-177*c* and the corresponding terminals 170*p*-177*p* may be established and the electric power may be supplied from the power supply 158 to the Hall devices 71 and the memory 141 via the terminals 174*p* and 174*c*. Further, the controller 100 may receive signals from the Hall device 71 of the black ink unit 40B via the terminals 170*c* and 170*p*, receiving signals from the Hall device 71 of the pretreatment liquid unit 40P via the terminals 171*c* and 171*p*, reading data from the memory 141 via the terminals 172*c* and 172*p*, and writing data into the memory 1.41 via the terminals 173*c* and 173*p*.

After the timing t5, the roller 148*c* may slide over the surface 48*d* and then contact a border between the surface 48*d* and the surface 48*e*, e.g., at timing t6 in FIG. 8, as depicted by the dashed line in FIG. 5. The roller 148*c* then may pass the border and contact the surface 48*e*. The roller 148*c* may further slide over the surface 48*e* toward an upstream end of the surface 48*e* with respect to the cartridge inserting direction. While the roller 148*c* slides over the surface 48*c*, the front surface 41*a* of the cartridge 40 may contact the protrusions 1*aap* of the front wall 1*aa*, e.g., at timing t7 in FIG. 8. At the timing t7, the installation of the cartridge 40 may be completed. At that time, the roller 148*c* may stop moving on the surface 48*e*, and the housing 41 of the cartridge 40 may be retained securely with respect to the space C, unless a force equal to or greater than a predetermined magnitude is applied in the direction opposite to the cartridge inserting direction.

Figure 7A:
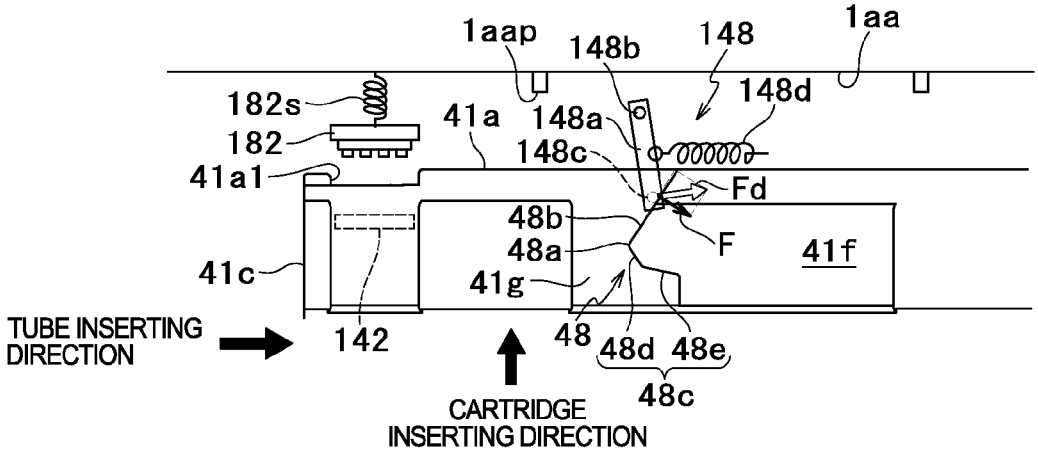
FIG. 7A is an enlarged view depicting an area VIIA in FIG. 6A according to an embodiment of the invention.
Figure 7B:
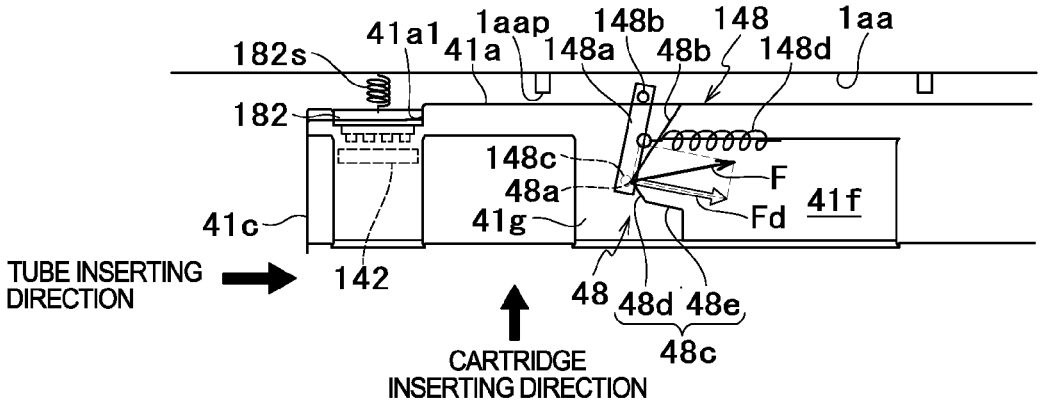
FIG. 7B is an enlarged view depicting an area VIIB in FIG. 6B according to an embodiment of the invention.
Figure 7C:
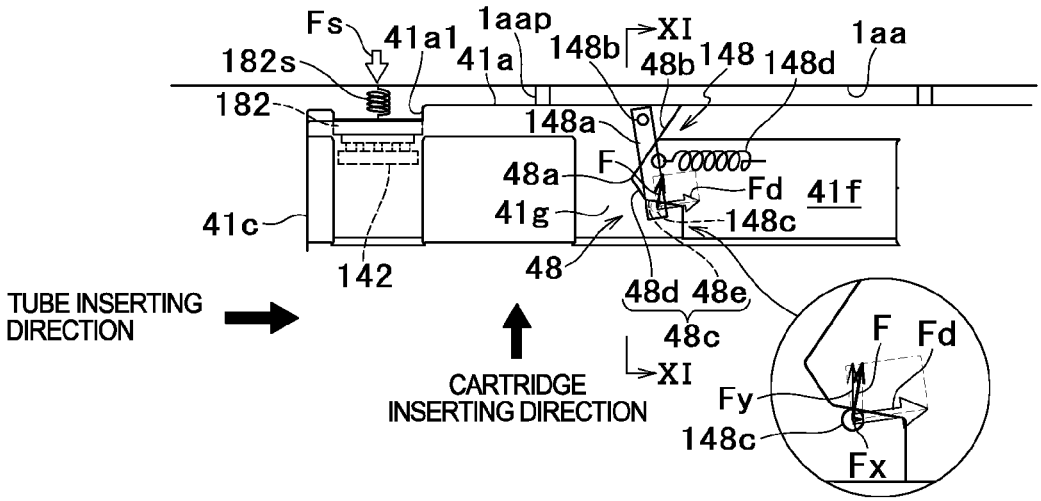
FIG. 7C is an enlarged view depicting an area VIIC in FIG. 6C according to an embodiment of the invention.

As depicted in FIGS. 7A-7C, during a period from the timing t1 to the timing t7, the lever 148*a* may rotate about the shaft 148*b* within the plane extending perpendicular to the vertical direction while being urged in a rotating direction by an elastic force of the spring 148*d*. The roller 148*c* may apply its urging force F to the engagement portion 48, and thus to the housing 41 of the cartridge 40, while the roller 148*c* is engaged with the engagement portion 48.

The urging force F may be a component of the urging force Fd that the spring 148*d* may apply to the roller 148*c*. The urging force Fd may act in a tangential direction of a path taken by the roller 148*c* when the lever 148*a* rotates about the shaft 148*b*, e.g., a circle with the shaft 148*b* as its center. The urging force F may be a normal component of the urging force Fd and act at right angles to a portion, with which the roller 148*c* may be in contact, of the engagement portion 48. The urging force F may be divided into a component Fx in a direction parallel to the cartridge inserting direction and a component Fy in a direction parallel to the tube inserting direction, as depicted in FIG. 7C.

When the roller 148*c* contacts the surface 48*b*, the urging force F may include a component in a direction opposite to the cartridge inserting direction and a component in the tube inserting direction, as depicted in FIG. 7A. When the roller 148*c* contacts one of the surface 48*d* and the surface 48*e*, the urging force F may include a component in the cartridge inserting direction and a component in the tube inserting direction, as depicted in FIG. 7C. When the roller 148*c* contacts the portion 48*a*, the urging force F may be changed from the urging force F including the component in the direction opposite to the cartridge inserting direction to the urging force F including the component in the cartridge inserting direction, as depicted in FIG. 7B. Therefore, the urging force F that may move the housing 41 in the direction opposite to the cartridge inserting direction and in the tube inserting direction may act on the housing 41 during the period from the timing t1 to the timing t4. After the timing t4, the urging force F that moves the housing 41 in the cartridge inserting direction and in the tube inserting direction may act on the housing 41. As described above, the urging force F may act on the housing 41 in the tube inserting direction from the timing t1. Thus, the side surface 41*d* of the housing 41 may contact the projecting part 1*adp* of the side wall 1*ad* reliably. The urging force F may act on the housing 41 in the cartridge inserting direction from the timing t4. Thus, the front surface 41*a* of the housing 41 may contact the protrusions 1*aap* of the front wall 1*aa* reliably.

The magnitude of the urging force Fd may be proportioned to the degree of expansion of the spring 148*d* from its natural state. During the period from the timing t1 to the timing t4, the spring 148*d* may extend gradually and the urging force Fd may also increase gradually. Thus, during the period from the timing t1 to the timing t4, the elastic force of the spring 148*d* may increase. As the roller 148*c* passes the portion 48*a* and contacts the one or both of the surfaces 48*d* and 48*e* after the timing t4, the spring 148*d* may contract and the urging force Fd having greater power may act on the one or both of the surfaces 48*d* and 48*e*, and thus, on the housing 41.

During the period from the timing t5 to the timing t7, the spring 182*s* may contract and an urging force Fs of the spring 182*s* may act on the housing 41 in the direction opposite to the cartridge inserting direction via the terminals 170*p*-177*p* and 170*c*-177*c*, as depicted in FIG. 7C. The urging force Fs may increase in accordance with the degree of contraction of the spring 182*s*. However, the component in the cartridge inserting direction in the urging force F may be greater than the urging force Fs starting from the timing t5.

After timing t7, an installation detection switch 159, as depicted in FIG. 9, may output an ON signal as the cover 1*c* is closed, e.g., at timing 8 in FIG. 8. Upon receipt of the ON signal, the controller 100 may determine that the cartridge 40 has been installed in the space C. The installation detection switch 159 may comprise a protrusion at a wall having the opening 10*c* in the housing 1*a*, as depicted in FIG. 1. The protrusion may protrude from the wall when the cover 1*c* is opened and may retract into the wall by the cover 1*c* when the cover 1*c* is closed. The installation detection switch 159 may be configured to output OFF signals when the protrusion protrudes from the wall and ON signals when the protrusion retracts in the wall.

When the controller 100 determines that the cartridge 40 has been installed in the space C, the controller 100 may read, from the memory 141 of the cartridge 40 the data of the amount of liquid remaining in each reservoir 42 and the sensor output values. The controller 100 then may control the moving mechanism 155, as depicted in FIG. 9, to move the support members 154 holding the respective hollow tubes 153 along the tube inserting direction, as depicted in FIG. 6D.

In accordance with the movement of the hollow tubes 153, the hollow tubes 153 may penetrate the respective plugs 50 disposed on the respective one ends of the ink outlet tubes 43 of the black ink unit 40B and the pretreatment liquid unit 40P along the primary direction, as depicted in FIG. 6D. Thus, the plugs 50 may be changed from a closing state to an open state. When the plug 50 is in the closing state, the plug 50 may not allow fluid communication between the ink outlet tube 43 and the exterior of the reservoir 42. When the plug 50 is in the open state, the plug 50 may allow fluid communication between the ink outlet tube 43 and the exterior of the reservoir 42. In each of the black ink unit 40B and the pretreatment liquid unit 20P, the hollow tube 153 may move while pushing a valve body of the valve disposed inside the ink outlet tube 43. Therefore, the valve may move from the closed position to the open position. Thus, fluid communication may be established between the reservoir 42 and the corresponding head 2 via the ink outlet tube 43, e.g., at timing t10 in FIG. 8.

During the period from the timing t8 to the timing t10, a force may act on the housing 41 in the tube inserting direction when the hollow tubes 153 are inserted into the respective ink outlet tubes 43 of the reservoirs 42. Therefore, the housing 41 may rotate counterclockwise in FIG. 6C about a portion of the side surface 41*d* that contacts the projecting part 1*adp*. Thus, the front surface 41*a* of the cartridge 40 may be separated from the protrusions 1*aap* and the protrusion 41*dp* of the side surface 41*d* of the cartridge 40 may contact the side wall 1*ad* defining the space C, e.g., at timing t9 in FIG. 8. In another embodiments, the timing t9 may occur at the same timing as the timing t10.

The controller 100 may determine whether the valves of the black ink unit 40B and the pretreatment liquid unit 40P are in the open positions in the respective ink outlet tubes 43 based on output values read from the memory 141 and the signals received from the Hall devices 71. When the controller 100 determines that the valves of the black ink unit 40B and the pretreatment liquid unit 40P are in the open positions, the controller 100 may determine whether a recording command has been received from the external device. When the controller 100 determines that the recording command has been received, the controller 100 may determine whether an amount of black ink and an amount of pretreatment liquid to be used in recording according to the recording command are less than the amount of black ink remaining and the amount of pretreatment liquid remaining, respectively. The amount of liquid to be used may be an amount of liquid to be discharged during recording according to the recording command and obtained based on image data included in the recording command. The data read from the memory 141 may be used for the amount of liquid remaining. When the amount of liquid to be used is greater than or equal to the amount of liquid remaining, the controller 100 may issue an error notification via an output device 160, e.g., a display or a speaker of the printer 1, as depicted in FIG. 9, and may stop operations of each components of the printer 1. When the amount of liquid to be use is less than the amount of liquid remaining, the controller 100 may control the sheet feed motor 125, the transport motor 127, a feed motor 128, and the heads 2 to perform recording on a sheet P.

During removal of the cartridge 40 from the space C, the user of the printer 1 first may open the cover 1*c*, as depicted in FIG. 1. When the cover 1*c* is opened, the installation detection switch 159 may output an OFF signal. Upon receipt of the OFF signal, the controller 100 may control the moving mechanism 155, as depicted in FIG. 9, to move the support members 154 in a direction opposite to the tube inserting direction. Thus, the support members 154 holding the respective hollow tubes 153 may move together with the valve bodies of the valves in the direction opposite to the tube inserting direction. In accordance with the movement of the hollow tube 153 leftward in FIG. 6D in each of the black ink unit 40B and the pretreatment liquid unit 40P, the valve also may move leftward in FIG. 6D from the open position to the closed position. Thus, the hollow tube may be removed from the plug 50 and separated from the ink outlet tube 43. The force may act on the housing 41 in the direction opposite to the tube inserting direction. Therefore, the housing 41 may rotate clockwise direction in FIG. 6D about the portion of the side surface 41*d* that contacts the projecting part 1*adp* of the side wall 1*ad* defining the space C. Thus, the protrusion 41*dp* of the side surface 41*d* of the cartridge 40 may be separated from the side wall 1*ad* defining the space C and the front surface 41*a* of the cartridge 40 may contact the protrusions 1*aap* of the front wall 1*aa*. The controller 100 may determine whether the valves of the black ink unit 40B and the pretreatment liquid unit 40P are in the closed positions in the respective ink outlet tubes 43 based on output values read from the memory 141 and the signals received from the Hall devices 71. When the controller 100 determines that the valves of the black ink unit 40B and the pretreatment liquid unit 40P are in the closed positions, the user may hold the hand well portion 49, with one hand and move the cartridge 40 in the direction opposite to the cartridge inserting direction to remove the cartridge 40 from the space C.

When the cartridge 40 is removed from the space C, the series of above-described operations may be performed in inverse order. Thus, when the cartridge 40 in the state depicted in FIG. 6C is moved in the direction opposite to the cartridge inserting direction, the roller 148*c* may slide over the surface 48*e* toward the surface 48*d* while receiving the urging force of the spring 148*d* via the lever 148*a*. While the roller 148*c* slides over the surface 48*e*, the front surface 41*a* of the cartridge may be separated from the protrusions 1*aap* of the front wall 1*aa*. Then, the roller 148*c* may contact the surface 48*d* and further slide over the surface 48*d* toward the portion 48*a*. While the roller 148*c* slides over the surface 48*d*, the terminals 170*p*-177*p* may be separated from the corresponding terminals 170*c*-177*c*. The roller 148*c* then may contact the portion 48*a*, pass the portion 48*a*, and then contact the surface 48*b*. The roller 148*c* may further slide over the surface 48*b* toward the downstream end of the surface 48*b* with respect to the cartridge inserting direction. While the roller 148*c* slides over the surface 48*b*, the substrate 182 may be positioned outside the recessed portion 41*a*1 of the cartridge 40. Further, the side surface 41*d* of the cartridge may be separated from the projecting part 1*adp* of the side wall 1*ad*. The roller 148*c* then may reach the downstream end of the surface 48*b* with respect to the cartridge inserting direction and be disengaged from the engagement portion 48 of the cartridge 40. The cartridge 40 then may be removed from the space C.

In the cartridge 40, the surface 48*c* may be configured to contact the roller 148*c* to allow the cartridge 50 to move along the cartridge inserting direction such that the terminals 170*c*-177*c* and the terminals 170*p*-177*p* may be made contact with each other. The printer 1 may comprise the roller 148*c* in the space C, and the roller 148*c* may be configured to move while contacting the surface 48*c* to allow the cartridge 40 to move along the cartridge inserting direction such that the terminals 170*c*-177*c* and the terminals 170*p*-177*p* may contact each other. In the printer 1, the roller 148*c* may contact the surface 48*b* first and then the surface 48*c* when the cartridge 40 is installed in the space C. Further, the contact portion of the roller 148*c*, which contact the surface 48*c*, and the surfaces of the terminals 170*p*-177*p*, e.g., the contact portions that may contact the corresponding terminals 170*c*-177*c* in the respective terminals 170*p*-177*p*, may also be disposed in this order with respect to the cartridge inserting direction. The portion 48*a* of the cartridge 40 and the surfaces of the terminals 170*c*-177*c* may be disposed in this order with respect to the cartridge inserting direction. With respect to the cartridge inserting direction, the distance D1 between the contact portion of the roller 148*c* and the surfaces of the terminals 170*p*-177*p* may be greater than the distance D2 between the portion 48*a* and the surfaces of the terminals 170*c*-177*c*, as depicted in FIG. 5. With this configuration, by contacting the roller 148*c* to the surface 48*c*, the cartridge 40 may be allowed to move along the cartridge inserting direction such that the terminals 170*c*-177*c* and the terminals 170*p*-177*p* may contact each other. Thus, the above-described configuration may reduce a contact failure between the terminals 170*c*-177*c* and the corresponding terminals 170*p*-177*p*.

In the printer 1, the roller 148*c* may be urged by the spring 148*d*. The cartridge 40 may comprise the surface 48*b* that may be configured to contact the roller 148*c* and increase the elastic force of the spring 148*d* before the surface 48*c* contacts the roller 148*c*. The printer 1 may comprise the spring 148*d* configured to urge the roller 148*c*. The roller 148*c* may be configured to move while contacting the surface 48*b* of the cartridge 40 and increasing the elastic force of the spring 148*d* before the roller 148*c* contacts the surface 48*c*. With this configuration, when the cartridge 40 is moved by the elastic force of the spring 148*d*, the elastic force of the spring 148*d* may be smoothly applied to the surface 48*c* and the cartridge 40 may be allowed to move along the cartridge inserting direction with further reliability. Thus, the configuration may further reduce a contact failure between the terminals 170*c*-177*c* and the corresponding terminals 170*p*-177*p*.

In the cartridge 40, the surface 48*c* may comprise the surface 48*d*, which may be contiguous to the surface 48*b*, and the surface 48*e*, which may be contiguous to the upstream end of the surface 48*d* with respect to the cartridge inserting direction. The angle θd formed by the surface 48*d* with respect to a straight line extending parallel to the cartridge inserting direction and passing the portion 48*a* may be less than the angle θe formed by the surface 48*e* with respect to the straight line. When the cartridge 40 is removed from the space C, the roller 148*c* may contact the surface 48*e*, the surface 48*d*, and the surface 48*b* successively in this order. With respect to the cartridge inserting direction, the distance D1 between the contact portion of the roller 148*c* and the surfaces of the terminals 170*p*-177*p* may be greater than the distance D2 between the portion 48*a* and the surfaces of the terminals 170*c*-177*c*, as depicted in FIG. 5. With this configuration, the cartridge 40 may be removed from the space C with a relatively reduced force. The distance D1 may be changed during the installation of the cartridge 40, as depicted in FIG. 7. The relationship of D1>D2 may be satisfied until at least the timing t3 at which the roller 148*c* contacts the portion 48*a*.

The cartridge 40 may comprise the guide portion, e.g., the wall defining the recessed portion 41*a*1, near the terminals 170*c*-177*c*. The guide portion may be configured to contact the substrate 182, such that the terminals 170*p*-177*p* may approach the terminals 170*c*-177*c* with respect to the vertical direction and the secondary direction, e.g., a direction perpendicular to the cartridge inserting direction, before the timing t3 at which the surface 43*c* contacts the roller 148*c*, e.g., at the timing t2. In the printer 1, the terminals 170*p*-177*p* may be disposed in the space C and configured to move in the direction perpendicular to the cartridge inserting direction. The cartridge 40 may comprise the guide portion. The surfaces of the terminals 170*c*-177*c* and the downstream end of the guide portion with respect to the cartridge inserting direction may be disposed in this order with respect to the cartridge inserting direction. With respect to the cartridge inserting direction, the distance D1 between the contact portion of the roller 148*c* and the surfaces of the terminals 170*p*-177*p* may be less than the distance D3 between the portion 48*a* and the downstream end of the guide portion with respect to the cartridge inserting direction. With this configuration, the reliability of the contact between the terminals 170*p*-177*p* and the corresponding terminals 170*c*-177*c* may be improved. More specifically, when the cartridge 40 is installed in the space C, the cartridge 40 may be deviated with respect to the space C by the contact of the roller 148*c* to the surface 48*c*. Therefore, when the terminals 170*p*-177*p* are guided by the guide portion after the roller 148*c* is made contact with the surface 48*c*, the terminals 170*p*-177*p* may move while the cartridge 40 has been deviated with respect to the space C. Thus, a positional deviation may occur between the terminals 170*p*-177*p* and the corresponding terminals 170*c*-177*c*, such that the terminals 170*p*-177*p* and the corresponding terminals 170*c*-177*c* may not contact each other properly. The roller 148*c* may be configured to contact the surface 48*c* after the terminals 170*p*-177*p* are guided by the guide portion and approach the terminals 170*c*-177*c* at the timing t2. Accordingly, the above-described configuration may reduce the contact failure.

A predetermined stroke may be provided between the time at which the terminals 170*p*-177*p* begin to be guided by the guide portion and the time at which the terminals 170*p*-177*p* and the corresponding terminals 170*c*-177*c* contact each other. When the cartridge 40 comprising the surfaces 48*b* and 48*c* and the terminals 170*p*-177*p* are guided by the guide portion after the roller 148*c* contacts the surface 48*c*, the length of the surface 48*c* may be greater with respect to the cartridge inserting direction to secure the predetermined stroke. However, if the length of the surface 48*c* is elongated with respect to cartridge inserting direction, the cartridge 40 may increase in size and thus the locking unit 148 of the housing 1 may also increase in size correspondingly. Accordingly, the above-described configuration may reduce the size of the cartridge 40 and the locking unit 148. The angle θd may be set to be less to secure the predetermined stroke when the surface 48*c* comprises the surfaces 48*d* and 48*e*. However, the urging force of the locking unit 148 in cartridge inserting direction may decrease when the roller 148*c* contacts the surface 48*d*. Accordingly, the above-described configuration may reduce or eliminate such a problem.

As depicted in FIG. 5, in the cartridge 40, the surface 48*c* may be disposed closer to the front surface 41*a* than the rear surface 41*b* with respect to the cartridge inserting direction. Thus, when the cartridge 40 is attached to the space C, the roller 148*c* may be allowed to contact the surface 48*c* and the cartridge 40 may move along the cartridge inserting direction at a relatively earlier stage. Therefore, this configuration may accomplish the speedy installation of the cartridge 40.

In the cartridge 40, the surface 48*c* may be disposed substantially in the middle of the side surface 41*c* and the side surface 41*d*. In the printer 1, the roller 148*c* may be disposed substantially in the middle of the side wall 1*ac* and the side wall 1*ad*. In the cartridge 40, the surface 48*c* may be disposed substantially in the middle of the upper surface 41*h* and the lower surface 41*e*. In the printer 1, the roller 148*c* may be disposed substantially in the middle of the upper wall 1*ah and* the lower wall 1*ac*. With this configuration, the force may be applied to the cartridge 40 uniformly via, the surface 48*c* and the roller 148*c* which contact the surface 48*c*. Therefore, the installation of the cartridge 40 may be performed with further reliability.

The cartridge 40 may comprise the hand well portion 49 into which the user may insert his/her hand. The hand well portion 49 and the surface 48*c* may be separated from each other and disposed on the same line extending substantially parallel to the cartridge inserting direction, as depicted in FIG. 5. Thus, the user may easily install or remove the cartridge 40 into or from the space C while putting his/her hand in the hand well portion 49. Further, because the hand well portion 49 and the surface 48*c* may be disposed as described above, the cartridge 40 may be properly installed in the space C while the surface 48*c* is positioned with respect to the roller 148*c*.

The cartridge 40 may comprise the front surface 41*a* provided with the terminals 170*c*-177*c*, and the ink outlet tubes 43 disposed at the side surface 41*c*. In the printer 1, the hollow tubes 153 may be disposed in the space C. The hollow tubes 153 may extend along the tube inserting direction and be configured to move along the tube inserting direction to be inserted into the respective ink outlet tubes 43. With this configuration, the contact between the terminals 170*c*-177*c* and the corresponding terminals 170*p*-177*p* and the insertion of the hollow tubes 153 into the respective ink outlet tubes 43 may be performed independently.

In the printer 1, the terminals 170*p*-177*p* may be urged in the direction opposite to the cartridge inserting direction and configured to move along the cartridge inserting direction against the urging force. The roller 148*c* may be configured to move while contacting the surface 48*c* of the cartridge 40 to allow the cartridge 40 and the terminals 170*p*-177*p* to move along the cartridge inserting direction after the terminals 170*c*-177*c* and the corresponding terminals 170*p*-177*p* contact each other. Thus, the reliability of the contact between the terminals 170*c*-177*c* and the corresponding terminals 170*p*-177*p* may be improved. Further, when the printer 1 has the configuration in which the terminals 170*p*-177*p* are urged in the direction opposite to the cartridge inserting direction, the above-described configuration may reduce a load on the user when the cartridge 40 is installed in the space C. If the printer 1 does not comprise the roller 148*c*, but the terminals 170*p*-177*p* are urged in the direction opposite to the cartridge inserting direction, increase effort may be required to insert the cartridge 40 into the space C against the urging force during the installation of the cartridge 40. According to the illustrative embodiment, the roller 148*c* may allow the cartridge 40 to move along the cartridge inserting direction smoothly. Therefore, the user may insert the cartridge 40 into the space C with ease.

In the printer 1, the terminals 170*p*-177*p* may be urged in a direction opposite to the cartridge inserting direction by the predetermined urging force Fs. The cartridge-inserting-direction force acting on the contact portion of the surface 48*c* contacting the roller 148*c* may be greater than the predetermined urging force Fs. Therefore, the load on the user may be further reduced during the installation of the cartridge 40.

The cartridge 40 may comprise the surface 48*c* configured to contact the roller 148*c* to allow the cartridge 40 to move along the tube inserting direction before the hollow tubes 153, which is configured to move along the tube inserting direction, are inserted into the respective ink outlet tubes 43. The printer 1 may comprise the roller 148*c* that may be disposed in the space C. The roller 148*c* may be configured to contact the surface 48*c* and move with contacting the surface 48*c* to allow the cartridge 40 to move along the tube inserting direction before the hollow tubes 153 are inserted into the respective ink outlet tubes 43. With this configuration, the installed position of the cartridge 40 may be adjusted with respect to the tube inserting direction before the hollow tubes 153 are inserted into the cartridge 40.

In the printer 1, the space C may be defined by the side wall 1*ad*. The cartridge 40 may move in the space C by the movement of the roller 148*c* and may contact the side wall 1*ad*. With this configuration, the cartridge 40 may be positioned in the predetermined position in the space C by using the side wall 1*ad*.

In the cartridge 40, while the cartridge 40 moves along the tube inserting direction, the surface 48*c* may contact the roller 148*c* to allow the cartridge 40 to move along the cartridge inserting direction. In the printer 1, while the cartridge 40 moves along the tube inserting direction, the roller 148*c* may contact the surface 48*c* of the cartridge 40 and slide on the surface 48*c* to allow the cartridge 40 to move along the cartridge inserting direction. With this configuration, the installed position of the cartridge 40 may be adjusted with respect to both the tube inserting direction and the cartridge inserting direction before the hollow tubes 153 are inserted into the cartridge 40.

In the printer 1, the space C may be defined by the front wall 1*aa*. The cartridge 40 may be moved in the space C by the movement of the roller 148*c* and may contact the front wall 1*aa*. With this configuration, the cartridge 40 may be positioned in the predetermined position in the space C by using the front wall 1*aa*.

The cartridge 40 may comprise the surface 48*b* configured to contact the roller 148*c* and increase the elastic force of the spring 148*d* before the surface 48*c* contacts the roller 148*c*. The printer 1 may comprise the spring 148*d* configured to urge the roller 148*c*. The roller 148*c* may be configured to move white contacting the surface 48*b* of the cartridge 40 and increasing the elastic force of the spring 148*d* before the roller 148*c* contacts the surface 48*c*. With this configuration, when the cartridge 40 is moved by the elastic force of the spring 148*d*, the elastic force of the spring 148*d* may be smoothly applied to the surface 48*c* and the cartridge 40 may move along the cartridge inserting direction with further reliability. Therefore, the installed position of the cartridge 40 may properly be adjusted with respect to the tube inserting direction before the hollow tubes 153 are inserted into the cartridge.

In the cartridge 40, the surface 48*c* may be disposed substantially in the middle of the side surface 41*c* and the side surface 41*d*. In the printer 1, the roller 148*c* may be disposed substantially in the middle of the side wall 1*ac* and the side wall 1*ad*. In the cartridge 40, the surface 48*c* may be disposed substantially in the middle of the upper surface 41*h* and the lower surface 41*e*. In the printer 1, the roller 148*c* may be disposed substantially in the middle of the upper wall 1*ah* and the lower wall 1*ae*. With this configuration, the force may be applied to the cartridge 40 uniformly via the surface 48*c* and the roller 148*c* contacting the surface 48*c*. Therefore, the installed position of the cartridge 40 may be properly adjusted with respect to the tube inserting direction before the hollow tubes 153 are inserted into the cartridge 40.

The cartridge 40 may comprise two ink outlet tubes 43. When the cartridge 40 comprises two or more ink outlet tubes 43, a force greater than a force, which acts on the cartridge 40 when a cartridge 40 has a single ink outlet tube 43, may act on the cartridge 40 when the hollow tubes 153 are inserted into the respective ink outlet tubes 43. Therefore, a risk of a positional deviation of the cartridge 40 in the space C may increase. Although a greater force acts on the cartridge 40 at the time of insertion of the hollow tubes 153, the installed position of the cartridge 40 may be properly adjusted with respect to the tube inserting direction.

The cartridge 40 may comprise the terminals 170*c*-177*c* on the front surface 41*a* and near the side surface 41*c*. Therefore, the terminals 170*c*-177*c* of the cartridge 40 may contact the corresponding terminals 170*p*-177*p* of the printer 1 at the substantially same time of the placement of the cartridge 40 in the space C.

The printer 1 may comprise the terminals 170*p*-177*p* configured to move in the tube inserting direction and in a direction opposite from the tube inserting direction. Therefore, this configuration may absorb the positional deviation with respect to the tube inserting direction to ensure the contact between the terminals 170*c*-177*c* and the terminals 170*p*-177*p*.

While the one or more aspects of the invention has been disclosed with respect to the specific embodiment thereof, it would be apparent to those skilled in the art that various changes, arrangements and modifications may be applied therein without departing from the spirit and scope of the invention.

Contents to be stored in the cartridge are not limited to black ink or pretreatment liquid. For example, the contents may be ink other than black, e.g., magenta, cyan, or yellow, aftertreatment liquid to be discharged onto a recording medium for improving image qualities, cleaning liquid for cleaning the transport belt, or waste liquid discharged from recording portions, e.g., heads, during a preliminary ejection, e.g., ejections not related to recording. The contents to be stored in the cartridge may be toner.

The cartridge may store two different kinds of contents, e.g., the black ink and the pretreatment liquid, individually. In another embodiment, the cartridge may store one or three or more kinds of contents.

The cartridge may comprise one or more reservoirs for storing the one or more contents, e.g., the reservoirs 42, and a container for accommodating the one or more reservoirs, e.g., the housing 41. In another embodiment, the container may not comprise a reservoir, but may directly store the one or more kinds of contents therein.

A first portion and a second portion of the cartridge may have any shape and be disposed at any respective positions. For example, the first portion may be disposed closer to one of a first side-surface and a second side-surface than the other of the first side-surface and the second side-surface but not substantially in the middle of the first side-surface and the second side-surface. The first portion may be disposed closer to one of an upper surface and a lower surface than the other of the upper surface and the lower surface but not substantially in the middle of the upper surface and the lower surface. Although the first portion may comprise two surfaces, in another embodiment, for example, one of the surfaces may be omitted, e.g., the surface 48*d* may be omitted from the first portion and the first portion may comprise the surface 48*e* only wherein the surface 48*b* may be contiguous to the surface 48*e* to have a substantially V-shape. The first portion may comprise a surface extending along the cartridge inserting direction. One or more surfaces may be disposed between the first portion and the second portion. The second portion may be omitted from the cartridge.

The number of communication portions to be provided, the position and the structure of the one or more communication portions may not be limited to the specific embodiment. For example, the communication portion are not limited to being disposed outside the housing of the cartridge but may be disposed inside the housing of the cartridge. The communication portion are not limited to a tube that may be attached to a bag, e.g., the reservoir 42. The communication portion may comprise a hole to be formed when a hollow tube is inserted into the bag or a film disposed at an opening of the reservoir for storing the content. Two or more communication portions may be provided for one reservoir.

In a recording apparatus, a cartridge receiving portion may be disposed at any position. In another embodiment, for example, the cartridge receiving portion may be disposed at an upper portion of the recording apparatus.

The number of electrical interfaces to be provided, the shape and the positional arrangement of the electrical interface are not limited to the specific embodiment. The electrical interface may not be limited to comprising a memory of the cartridge and a terminal for communicating with a sensor of the cartridge, e.g., a communication terminal, but may comprise a power input terminal only without the communication terminal. The electrical interface are not limited to being held by a spring but may be held by an elastic body, e.g., sponge or rubber. The electrical interface are not limited to being configured to be movable in a predetermined direction or in its opposite direction. For example, the electrical interface may be fixed in the cartridge receiving portion. The electrical interface are not limited to be configured to move in a direction perpendicular to the cartridge inserting direction in the cartridge receiving portion. For example, the electrical interface may be fixed to the cartridge receiving portion. The electrical interface may be disposed on one of side walls defining the cartridge receiving portion but not disposed on a front wall defining the cartridge receiving portion. The electrical interface may be omitted from the cartridge receiving portion.

In another embodiment, for example, a movable member may be configured to move while contacting the first portion of the cartridge to allow the cartridge to move in the predetermined direction and in is opposite direction only. The movable member may be configured to move while contacting the first portion of the cartridge to allow the cartridge to move in the cartridge inserting direction only. The movable member may have any shape and be disposed at any position in the cartridge receiving portion. For example, the movable member may be disposed closer to one of a first side-wall and a second side-wall than the other of the first side-wall and the second side-wall but not substantially in the middle of the first side-wail and the second side-wall. The movable member may be disposed closer to one of an upper wall and a lower wall than the other of the upper wall and the lower wall but not substantially in the middle of the upper wall and the lower wall.

The structure of a connection between the movable member and an elastomeric member are not limited to the specific embodiment. For example, the spring 148*d* may be attached to the left side-surface of the lever 148*a* in FIG. 7, and the spring 148*d* may contract when the roller 148*c* contacts the surface 48*b* and extend when the roller 148*c* contact the surface 48*c*. The movable member is not limited to being urged by the elastomeric member. For example, the recording apparatus may comprise a mechanism configured to move the movable member in the predetermined direction and in its opposite direction. Thus, the mechanism may move the movable member in one of the predetermined direction and its opposite direction while contacting the movable member with the first portion of the cartridge. The movable member is not limited to being urged by the elastomeric member. For example, the recording apparatus may comprise a mechanism configured to move the movable member in the cartridge inserting direction. In this case, the mechanism may move the movable member in the cartridge inserting direction while contacting the movable member with the first portion of the cartridge.

The electrical interface may be urged in a direction opposite to the cartridge inserting direction by a predetermined force, and a cartridge-inserting-direction force acting on a contact portion of the first portion that contacts the movable member may be greater than a predetermined urging force.

One or more walls with which the cartridge contact may comprise a portion with which the cartridge moved by the movable member may contact, e.g., a flat wall, a protrusion protruding from the flat wall, or a raised portion of a wall. For example, the projecting part 1*adp* may be omitted from the side wall 1*ad* and the side surface 41*d* of the cartridge 40 may contact the flat side wall 1*ad* defining the space C. The protrusions 1*aap* may be omitted from the front wall 1*aa* and the front surface 41*a* of the cartridge 40 may contact the flat front wall 1*aa*.

When the cartridge is relatively heavy or when a force that acts on the cartridge is relatively small during the insertion of the hollow tube, the cartridge may not be moved by the insertion of the hollow tube although the cartridge does not contact the one or more walls defining the cartridge receiving portion. Therefore, the cartridge may not contact the one or more walls defining the cartridge receiving portion by the movement of the movable member.

An arbitrary number of hollow tubes may be provided and the position of one or more hollow tubes may be also arbitrarily changed.

The number of recording portions (e.g., heads) to be provided in the recording apparatus is not limited to two. The recording apparatus may be a color inkjet printer comprising recording portions for discharging inks of black, magenta, cyan, and yellow.

The recording apparatus may be a line-type recording apparatus or a serial-type recording apparatus. In another embodiments, the recording apparatus may be applied to not only printers but also facsimile machines or copying machines, or any other suitable machine for ejecting ink, for example. The recording apparatus may be a laser recording apparatus.

The cartridge inserting direction may extend parallel to the primary direction. In another embodiment, the cartridge inserting direction may extend parallel to one of the vertical direction and the secondary direction. The direction that the hollow tube may be moved, e.g., the predetermined direction, may intersect the cartridge inserting direction, but is not limited to extending perpendicular to the cartridge inserting direction.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. A cartridge comprising:

a substrate comprising a first surface on which an electrical terminal is disposed, the first surface facing a first direction; and an engagement portion comprising:

a second surface disposed upstream from the substrate in the first direction, wherein the second surface faces a second direction, which forms an obtuse angle with the first direction; and a third surface facing a third direction, which forms an acute angle with the first direction, wherein the third surface does not overlap with the substrate in the first direction, and wherein the third surface is disposed downstream from the second surface in the first direction, wherein a downstream end of the third surface is disposed downstream from the substrate in the first direction, wherein the cartridge comprises an outlet portion configured to direct liquid from an interior of the cartridge to an exterior of the cartridge in a fourth direction, which is perpendicular to the first direction, but not parallel to the second surface or the third surface, wherein the outlet portion is disposed upstream from the substrate in the first direction, wherein the outlet portion is disposed upstream from the third surface in the first direction, wherein the outlet portion is disposed upstream from the second surface in the first direction, wherein the outlet portion is disposed downstream from the substrate in the fourth direction, wherein the third surface is disposed upstream from the substrate in the fourth direction, wherein each of the second direction and the third direction forms an acute angle with the fourth direction, wherein the cartridge further comprises a fourth surface and a fifth surface parallel to each other and extending parallel to the first direction and perpendicular to the second and third surfaces, wherein the substrate is disposed between the engagement portion and the fifth surface with respect to a fifth direction, which is perpendicular to the first direction and parallel to the second surface and the third surface, and wherein the outlet portion is disposed between the engagement portion and the fifth surface with respect to the fifth direction.

2. The cartridge of claim 1, wherein the electrical terminal comprises a row of electrical terminals extending in the fourth direction.

3. The cartridge of claim 1, further comprising two side surfaces parallel to each other and extending in the first direction, wherein the two side surfaces overlap with each other in the fourth direction, which is perpendicular to the first direction, but not parallel to the second surface or the third surface, and wherein the engagement portion is disposed between the two side surfaces with respect to the fourth direction.

4. The cartridge of claim 3, wherein distances from each of the side surfaces to the engagement portion is greater than one third of a distance between the side surfaces in the fourth direction.

5. The cartridge of claim 1, further comprising a front surface and a rear surface, wherein the front surface faces the first direction and the rear surface faces a direction opposite of the first direction, wherein the rear surface and the front surface overlap each other in the first direction, and wherein the second surface is disposed closer to the front surface than to the rear surface with respect to the first direction.

6. The cartridge of claim 1, further comprising a front surface and a rear surface, wherein the front surface faces the first direction and the rear surface faces a direction opposite of the first direction, wherein the rear surface and the front surface overlap each other in the first direction, and wherein the substrate is disposed between the front surface and the rear surface with respect to the first direction.

7. The cartridge of claim 1, wherein the engagement portion is disposed between the fourth surface and the fifth surface with respect to the fifth direction, which is perpendicular to the first direction and parallel to the second surface and the third surface.

8. The cartridge of claim 7, wherein distances from each of the fourth surface and the fifth surface to the engagement portion is greater than one third of a distance between the fourth surface and the fifth surface in the fifth direction.

9. The cartridge of claim 1, wherein an upstream end of the third surface is disposed upstream from the substrate in the first direction.

10. The cartridge of claim 1, wherein the engagement portion further comprises the fourth surface, wherein a downstream end of the fourth surface in the first direction is contiguous to an upstream end of the third surface in the first direction, wherein an downstream end of the second surface in the first direction is contiguous to an upstream end of the fourth surface, wherein the fourth surface faces a sixth direction, which forms an obtuse angle with the first direction, wherein the obtuse angle formed between the sixth direction and the first direction is less than the obtuse angle formed between the second direction and the first direction, and wherein each of the second surface, the third surface, and the fourth surface comprises a plane surface.

11. The cartridge of claim 10, wherein the second direction forms an acute angle with a direction opposite of the first direction; and wherein the acute angle formed between the second direction and the direction opposite of the first direction is less than the acute angle formed between the third direction and the first direction.

12. The cartridge of claim 1, further comprising a holding portion, wherein the engagement portion is disposed downstream from the holding portion in the first direction, and wherein the engagement portion and the holding portion overlap each other in the first direction.

13. The cartridge of claim 1, wherein the second surface and the third surface form a curved surface.

14. The cartridge of claim 1, wherein each of the second surface and the third surface comprises a plane surface.

* * * * *